US011052279B1

(12) United States Patent
Vujicic et al.

(10) Patent No.: US 11,052,279 B1
(45) Date of Patent: Jul. 6, 2021

(54) EXERCISE MACHINE

(71) Applicant: NPD Team, LLC, Tustin, CA (US)

(72) Inventors: Marko Vujicic, Huntington Beach, CA (US); Greg Wallace, Mission Viejo, CA (US)

(73) Assignee: NPD Team, LLC, Tustin, CA (US)

( * ) Notice: Subject to any disclaimer, the term of this patent is extended or adjusted under 35 U.S.C. 154(b) by 0 days.

(21) Appl. No.: 17/110,106

(22) Filed: Dec. 2, 2020

Related U.S. Application Data

(60) Provisional application No. 63/042,518, filed on Jun. 22, 2020.

(51) Int. Cl.
*A63B 21/00* (2006.01)
*A63B 22/20* (2006.01)
(Continued)

(52) U.S. Cl.
CPC ..... *A63B 21/152* (2013.01); *A63B 21/0552* (2013.01); *A63B 21/4035* (2015.10); *A63B 22/203* (2013.01); *A63B 23/03525* (2013.01)

(58) Field of Classification Search
CPC ..... A63B 21/00058; A63B 21/00069; A63B 21/00076; A63B 21/008; A63B 21/0085; A63B 21/0088; A63B 21/012; A63B 21/0125; A63B 21/015; A63B 21/018; A63B 21/02; A63B 21/021; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/15; A63B 21/151; A63B 21/152; A63B 21/153; A63B 21/154; A63B 21/156; A63B 21/157; A63B 21/22; A63B 21/225; A63B 21/227; A63B 21/4027; A63B 21/4029; A63B 21/0431; A63B 21/4033; A63B 21/4035; A63B 21/4045; A63B 21/4047; A63B 21/4049; A63B 22/0046;
(Continued)

(56) References Cited

U.S. PATENT DOCUMENTS 4,625,962 A * 12/1986 Street ..... A63B 21/015 482/116
4,709,918 A * 12/1987 Grinblat ..... A63B 21/012 482/118
5,409,435 A * 4/1995 Daniels ..... A63B 21/0056 482/5
5,951,449 A * 9/1999 Oppriecht ..... A63B 21/0087 482/103
(Continued)

*Primary Examiner* — Gary D Urbiel Goldner
(74) *Attorney, Agent, or Firm* — Eric Karich; Karich & Associate

(57) ABSTRACT

An exercise machine has a base housing and a boom that extends from a proximal end to a distal end. The boom is able to pivot between a rowing configuration wherein the boom is generally horizontal, and a skiing configuration wherein the boom is generally vertical. A rowing assembly includes a row handle attached to a row chain which extends into the base housing, to a row recoil device. A ski assembly includes a pair of ski handles, each ski handle being attached to a ski rope which extends into the base housing, to a ski recoil device. A transmission system has a shaft that is operably connected to a resistance device, the shaft having a row sprocket and a pair of ski spools, and the respective cables contact the spools so that movement of one of the cables rotates the respective spool, thereby rotating the shaft.

12 Claims, 27 Drawing Sheets

(51) Int. Cl.
*A63B 23/035* (2006.01)
*A63B 21/055* (2006.01)

(58) Field of Classification Search
CPC ..... A63B 22/0076; A63B 22/0087; A63B 22/0089; A63B 22/18; A63B 22/20; A63B 22/201; A63B 22/203; A63B 2022/0079; A63B 23/035; A63B 23/03516; A63B 23/03525; A63B 23/03533; A63B 23/03541; A63B 23/03558; A63B 23/03566; A63B 69/06; A63B 69/18; A63B 69/182; A63B 2069/062; A63B 71/0054; A63B 2071/0063; A63B 2071/0072; A63B 2208/0204; A63B 2208/0228; A63B 2208/0233; A63B 2208/0238; A63B 2210/00; A63B 2210/10; A63B 2210/50; A63B 2225/09; A63B 2225/093; A63B 2225/10; A63B 2225/102; A63B 2244/19
See application file for complete search history.

(56) References Cited

U.S. PATENT DOCUMENTS

| | | | | |
|---|---|---|---|---|
| 6,071,215 | A * | 6/2000 | Raffo | A63B 21/153 482/57 |
| 8,323,157 | B2 * | 12/2012 | Campanaro | A63B 24/00 482/96 |
| 8,517,899 | B2 * | 8/2013 | Zhou | A63B 69/182 482/71 |
| 10,279,214 | B2 * | 5/2019 | Chiang | A63B 22/203 |
| 10,449,409 | B2 * | 10/2019 | Hamilton | A63B 21/012 |
| 10,828,530 | B1 * | 11/2020 | Vujicic | A63B 21/152 |
| 2004/0248713 | A1 * | 12/2004 | Campanaro | A63B 23/03575 482/123 |
| 2007/0203004 | A1 * | 8/2007 | Campanaro | A63B 21/4043 482/142 |
| 2011/0281698 | A1 * | 11/2011 | Wyeroski | A63B 21/153 482/116 |
| 2016/0001123 | A1 * | 1/2016 | Parrish, Jr. | A63B 22/0076 482/72 |
| 2020/0171346 | A1 * | 6/2020 | Chen | A63B 22/205 |

* cited by examiner

EXERCISE MACHINE

CROSS-REFERENCE TO RELATED APPLICATIONS

This application for a utility patent claims the benefit of U.S. Provisional Application No. 63/042,518 filed Jun. 22, 2020.

BACKGROUND OF THE INVENTION

Field of the Invention

This invention relates generally to exercise machines, and more particularly to an exercise machine that combines the functionality of a ski exercise machine and a rower.

Description of Related Art

The prior art teaches a variety of ski exercise machines, which include a pair of handles mounted on a vertical boom, so they may be pulled down to simulate a skiing exercise. The prior art also teaches a rower which includes a horizontal boom having a sliding seat upon which the user may slide while engaging in a simulated rowing exercise.

The prior art teaches combination exercise machines. However, the prior art does not teach a single machine that may provide various different exercise options using a single transmission system as described herein. The present invention fulfills these needs and provides further advantages, as described in the following summary.

SUMMARY OF THE INVENTION

The present invention teaches certain benefits in construction and use which give rise to the objectives described below.

The present invention provides an exercise device that includes a first exercise assembly that is connected with a first rope which extends into a base housing, and a second exercise assembly that is connected with a second rope which extends into the base housing. The exercise device further includes a resistance device. A transmission system within the base housing connects the first rope and the second rope to the resistance device. The transmission system includes a shaft that is operably connected to the resistance device, the shaft having first and second spools that are mounted on the shaft with one way bearings; and wherein the first rope contacts the first spool, and the second rope contacts the second spool, so that movement of either of the first or second ropes rotates the respective spool, thereby rotating the shaft against the resistance of the resistance device.

In one embodiment, the exercise machine comprising a base housing, a boom having an elongate rigid body that extends from a proximal end to a distal end, and a pivot mount which pivotally mounts the proximal end of the boom on the base housing. The boom is able to pivot with respect to the base housing between a rowing configuration wherein the boom is generally horizontal, and a skiing configuration wherein the boom is generally vertical. A seat element is slidably mounted on the boom, for use with a rowing assembly that includes a row handle attached to a proximate end of a row chain which extends around at least one guide pulley and into the base housing. A distal end of the row chain is attached to a row recoil device. A ski assembly includes a pair of ski handles, each ski handle being attached to a proximal end of a ski rope which extends through a ski handle stop at a distal end of the base housing, around at least one guide pulley, and into the base housing. A distal end of the ski rope is attached to a ski recoil device. A resistance device interacts with a transmission system within the base housing that connects the ski rope and the row chain to the resistance device. The transmission system comprises a shaft that is operably connected to the resistance device, the shaft having a row sprocket and a pair of ski spools, each of the row and ski sprocket/spools being mounted upon one-way bearings on the shaft. Each of the ski ropes contacts one of the ski spools so that movement of the ski rope rotates the ski spool, thereby rotating the shaft. The row chain contacts the row sprocket so that movement of the row chain rotates the row sprocket, thereby rotating the shaft.

A primary objective of the present invention is to provide an exercise machine having advantages not taught by the prior art.

Another objective is to provide an exercise machine that has a boom capable of pivoting to provide the functionality of both a ski exercise machine and a row exercise machine.

A further objective is to provide an exercise machine that has a transmission system adapted for different types of resistance exercise.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an exercise machine with a transmission that is adapted for use with different configurations of the exercise machine.

The exercise device of the present invention includes two or more exercise assemblies in a single unit that both utilize a single transmission. In this embodiment, a first exercise assembly is connected with a first rope which extends into a base housing, and a second exercise assembly is connected with a second rope which extends into the base housing. The exercise device further includes a resistance device and a transmission system that is connected with the first rope and the second rope. The transmission system is described in greater detail below. While two exemplary exercise assemblies are described in greater detail below, those skilled in the art may devise two or more alternative exercise assemblies that may be used in conjunction with the transmission system, and these alternative arrangements should be considered within the scope of the present invention.

Figure 1:
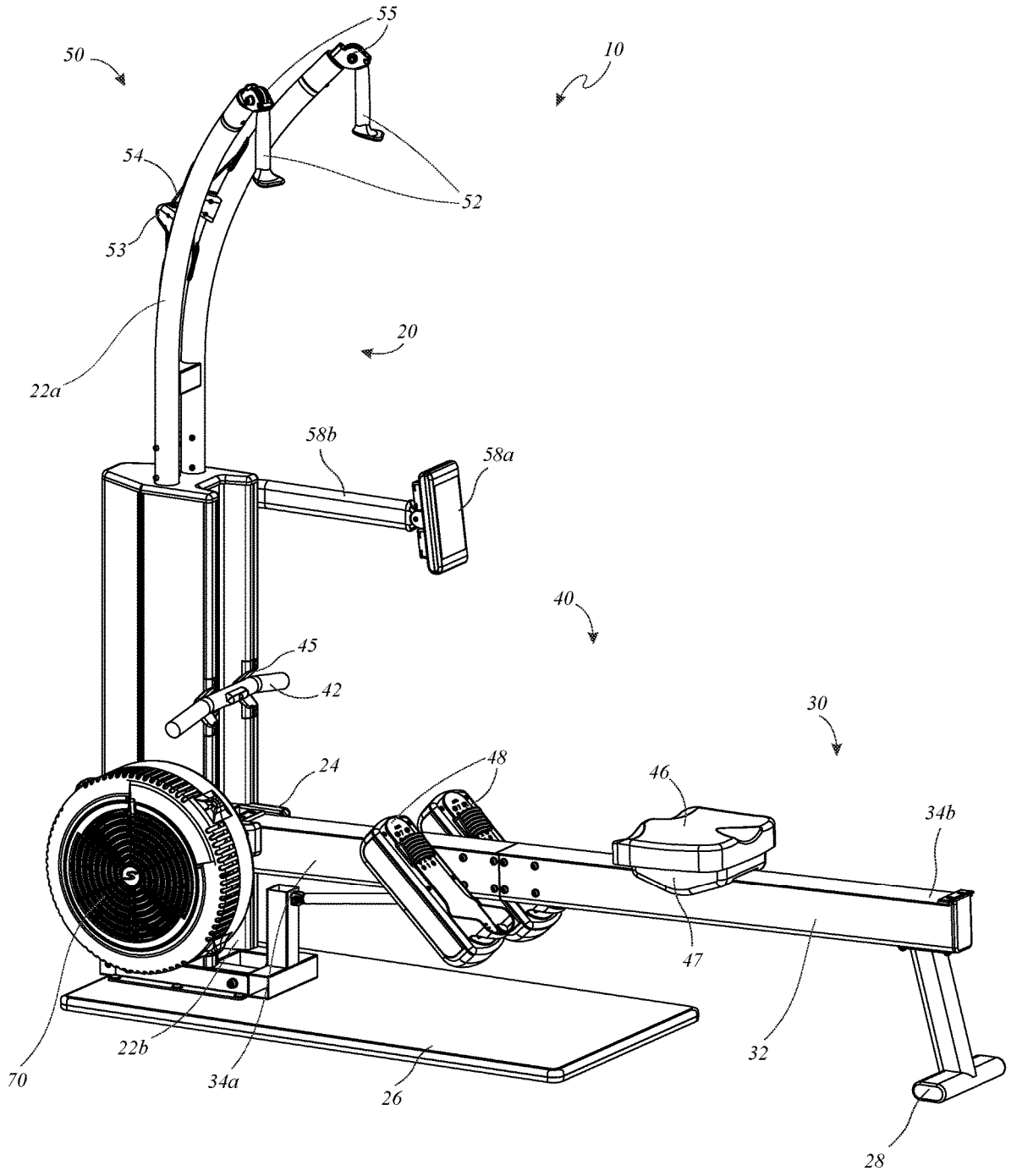
FIG. 1 is a left side perspective view of an exercise machine in a rowing configuration with a support platform installed.
Figure 2:
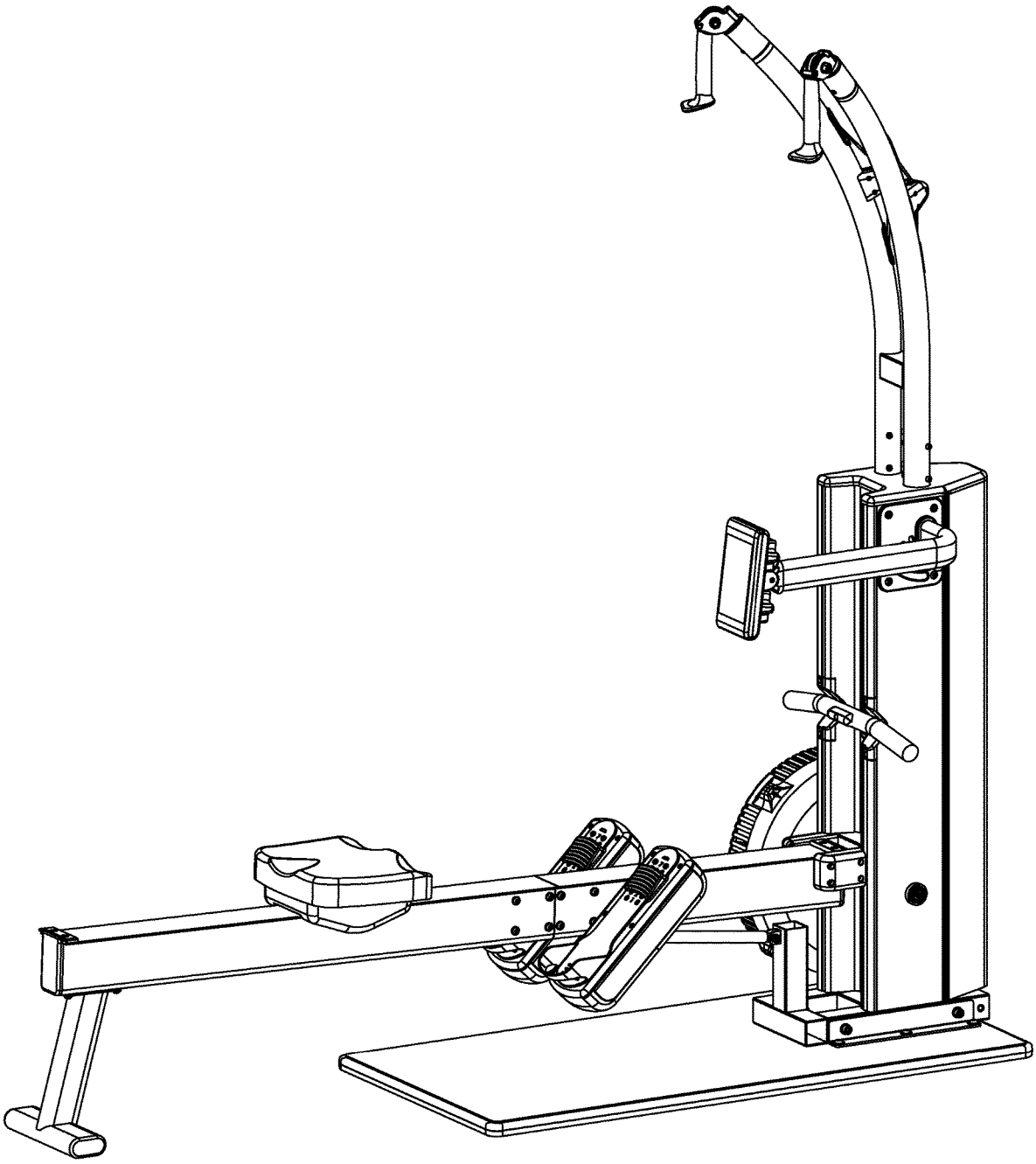
FIG. 2 is a right side perspective view thereof.
Figure 3:
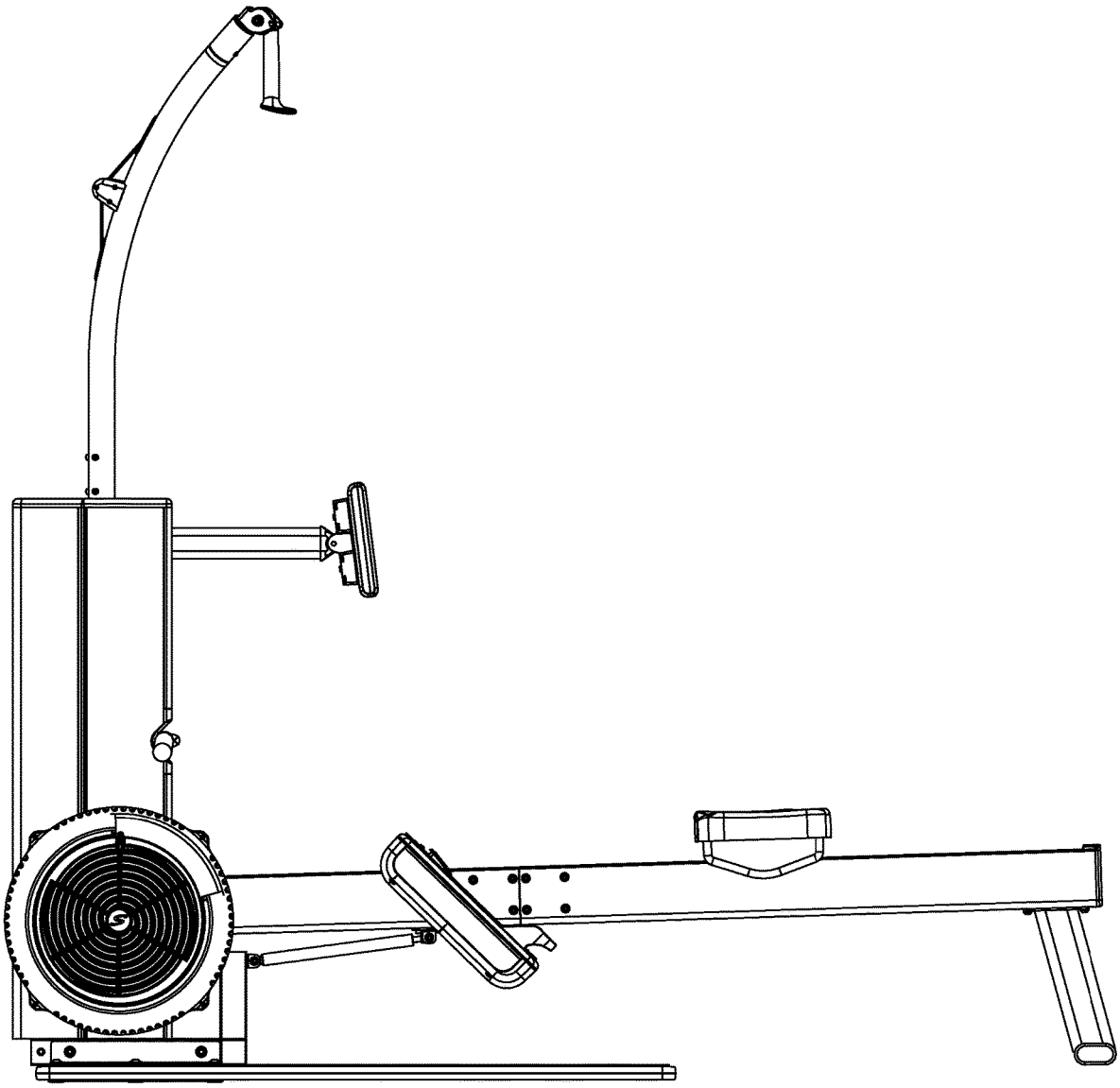
FIG. 3 is a left side elevational view thereof.
Figure 4:
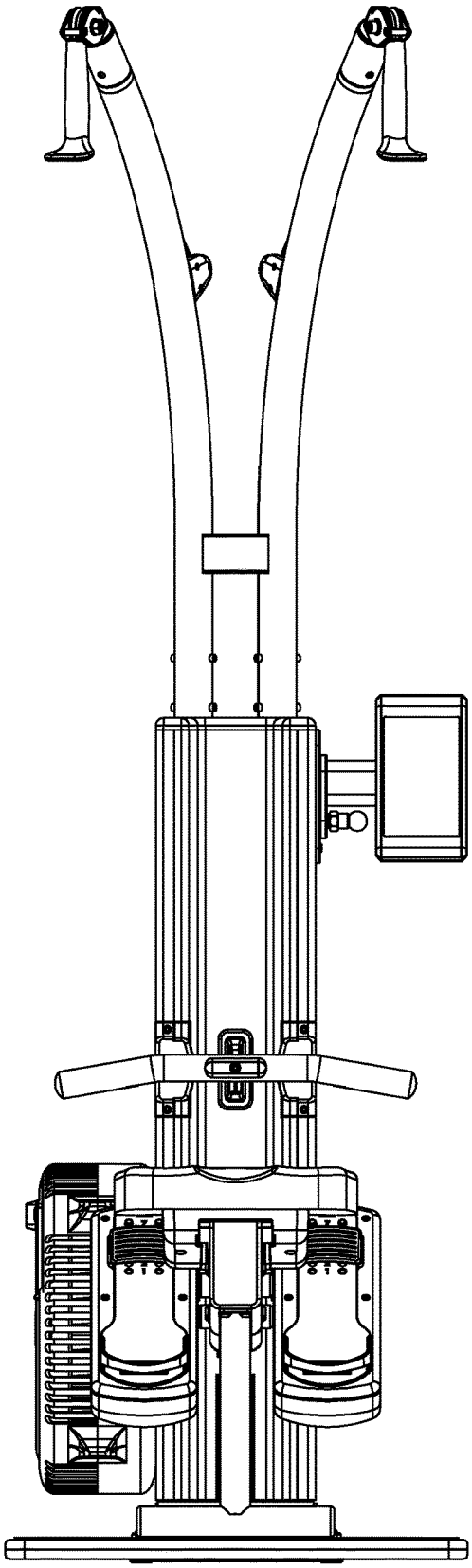
FIG. 4 is a front elevational view thereof.
Figure 5:
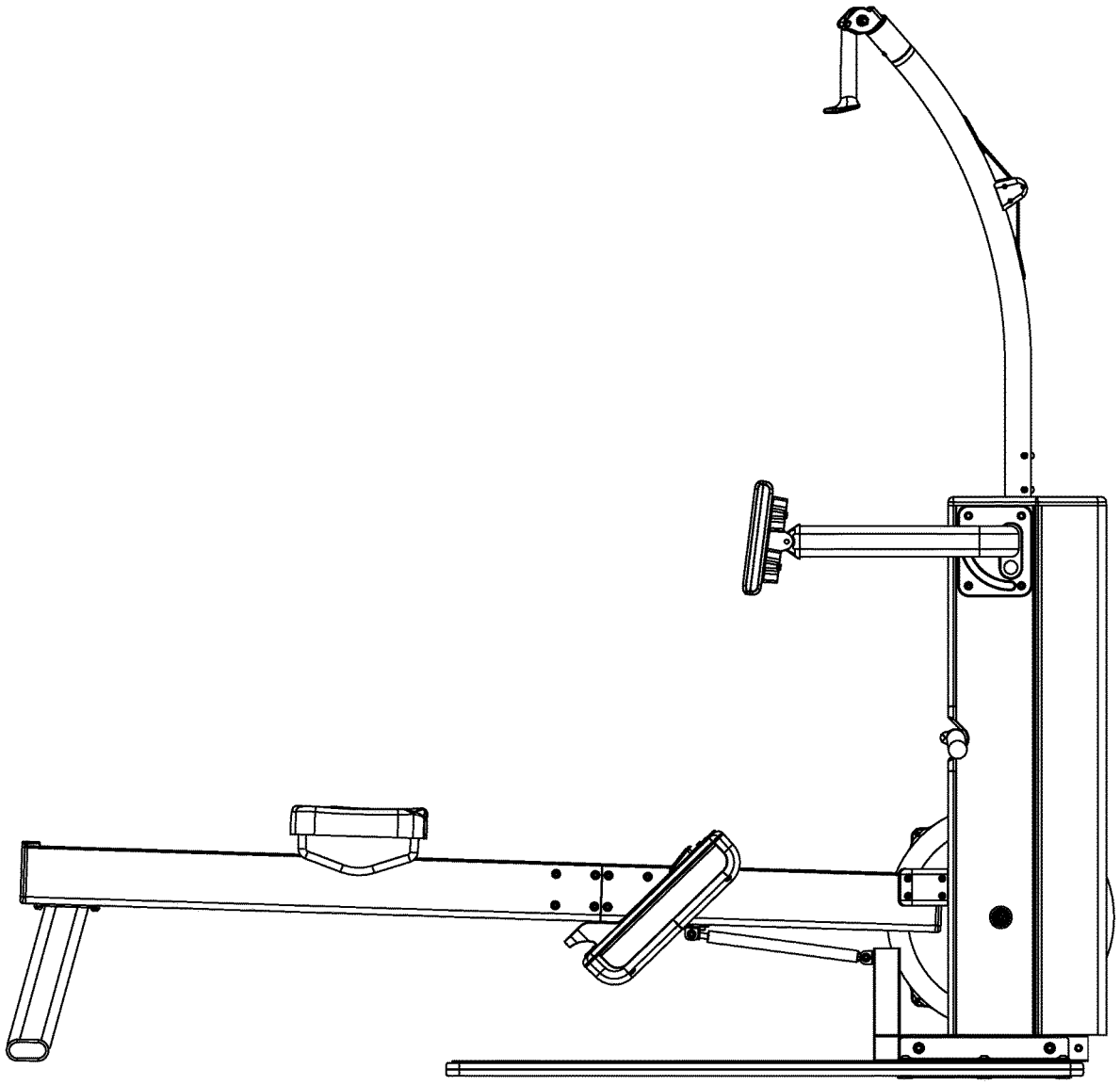
FIG. 5 is a right side elevational view thereof.
Figure 6:
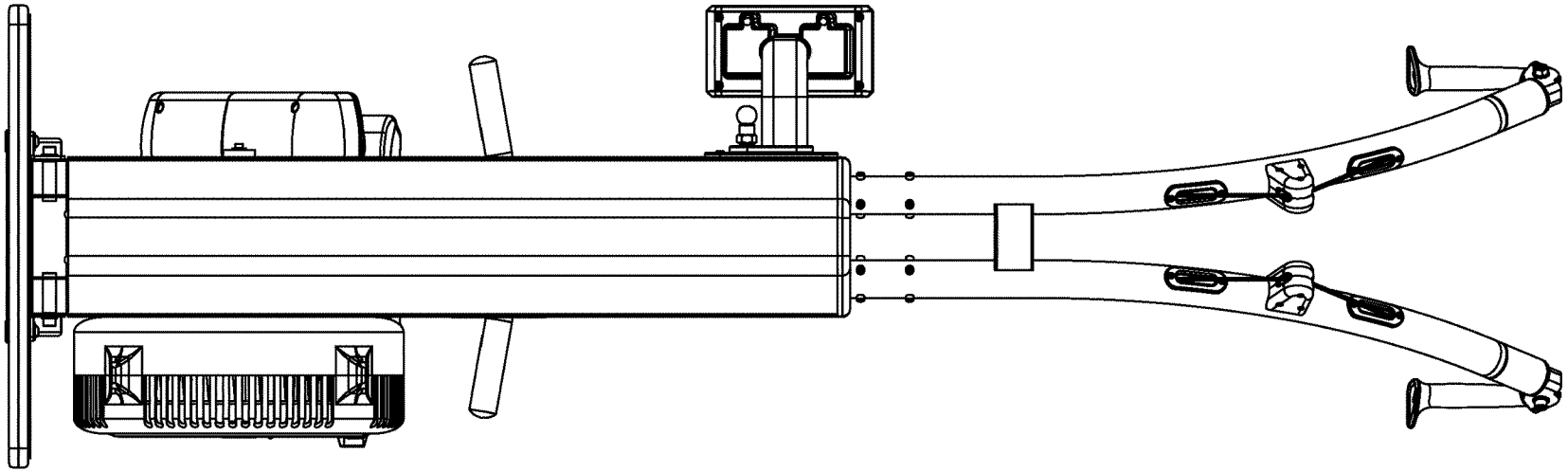
FIG. 6 is a rear elevational view thereof.

FIG. 1 is a left side perspective view of an exercise machine 10 of one embodiment of the present invention. The exercise machine 10 of FIG. 1 is shown in a rowing configuration. FIG. 2 is a right side perspective view thereof, FIG. 3 is a left side elevational view thereof, FIG. 4 is a front elevational view thereof, FIG. 5 is a right side elevational view, and FIG. 6 is a rear elevational view thereof. As shown in FIGS. 1-6, the exercise machine 10 of this embodiment includes a base housing 20 pivotally attached to a boom 30, the exercise machine 10 further having a transmission system 60 (shown in FIG. 27) and a resistance device 70, each discussed below.

The boom 30 has an elongate rigid body 32 that extends from a proximal end 34*b* to a distal end 34*a*. The base housing 20 includes a pivot mount 24 which pivotally mounts the proximal end 34*b* of the boom 30 on the base housing 20 such that the boom 30 is able to pivot with respect to the base housing 20 between the rowing configuration wherein the boom 30 is generally horizontal (shown in FIGS. 1-6 and 13-18), and a skiing configuration wherein the boom 30 is generally vertical (shown in FIGS. 7-12 and 19-24), each configuration being discussed in greater detail below. The boom 30 may optionally include a locking mechanism 36 to secure the boom 30 in the generally vertical orientation. In another embodiment, the boom 30 may be fixedly attached to the base housing 20, wherein the boom 30 is generally horizontal allowing for rowing exercises in the same manner as the first embodiment and the opposite side of the base housing 20 can be used for skiing exercises.

The base housing 20 further includes a distal end 22*a*, and a proximal end 22*b* which may include a support platform 26 for the machine 10. In this embodiment, the support platform 26 is in the form of a planar sheet, but other mechanisms may be used to stabilize the exercise machine 10, as shown in FIGS. 13-26 and discussed below. The boom 30 may extend from the pivot mount 24 at the distal end 34*a* to the proximal end 34*b* to supporting legs 28 to further stabilize the exercise machine 10 during use.

A user may exercise using a rowing assembly 40 in the rowing configuration. The rowing assembly 40 includes a row handle 42 attached to a proximal end 44*a* of a row chain 44 that extends around at least one guide pulley 43 and upwardly into the base housing 20, where a distal end 44*b* of the row chain 44 is attached to a row recoil device 76*b* (all best shown in FIG. 27). In this embodiment, the row handle 42 is in the form of a t-handle, but in other embodiments, may be any type of handle known in the art (e.g., separate handles, loops, etc.). A handle receiver 45 may be mounted on the base housing 20 to catch and hold the row handle 42 and hold it for easy access by the user while not in use. In this embodiment, the row handle 42 is held in the handle receiver 45 via tension from the row recoil device to 76*b*. The handle receiver 45 may be in the form of a variety of attachment mechanisms/structures (e.g., receiving structures, straps, etc.) devised by those skilled in the art to hold the row handle 42 in place when not in use, and such structures should be considered within the scope of the current invention.

As used in this application, the terms "chain" and "rope" are defined to include any form of cable, rope, belt, cord, bungee, chain, or similar or equivalent element known in the art that is useful for the purposes described herein.

Figure 25:
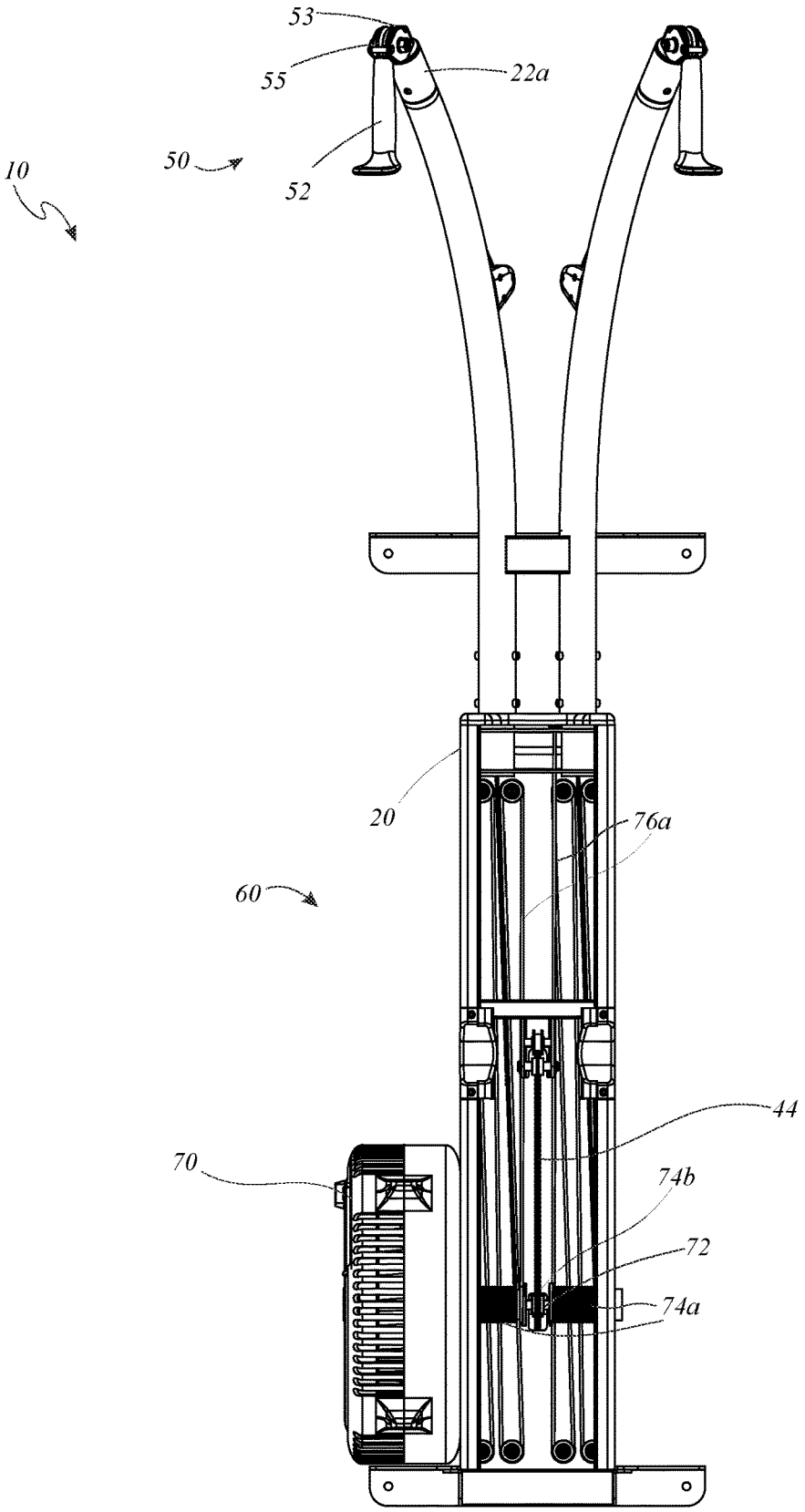
FIG. 25 is a front elevational view of the exercise machine showing one embodiment of a transmission system.
Figure 26:
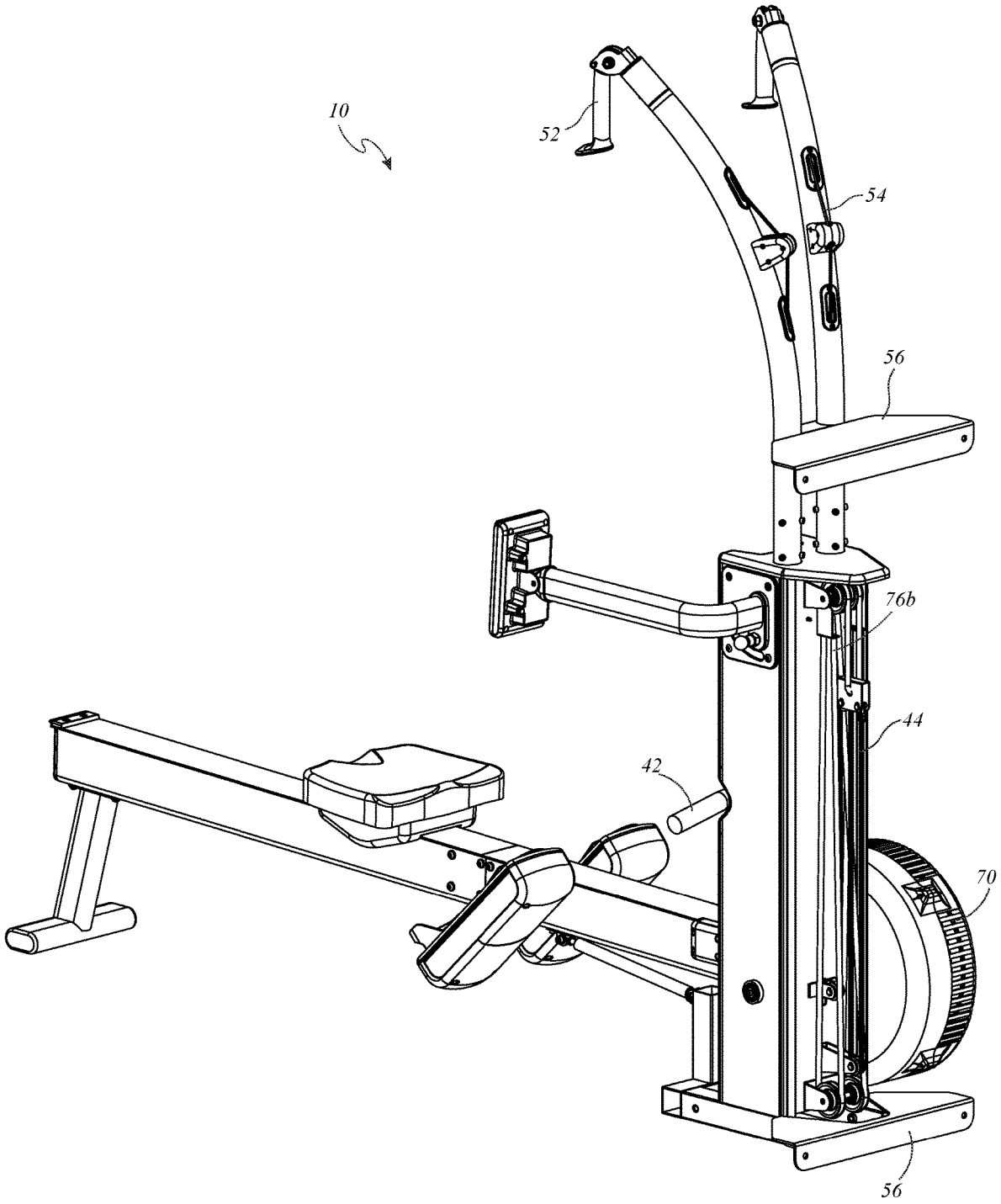
FIG. 26 is a perspective view thereof.
Figure 27:
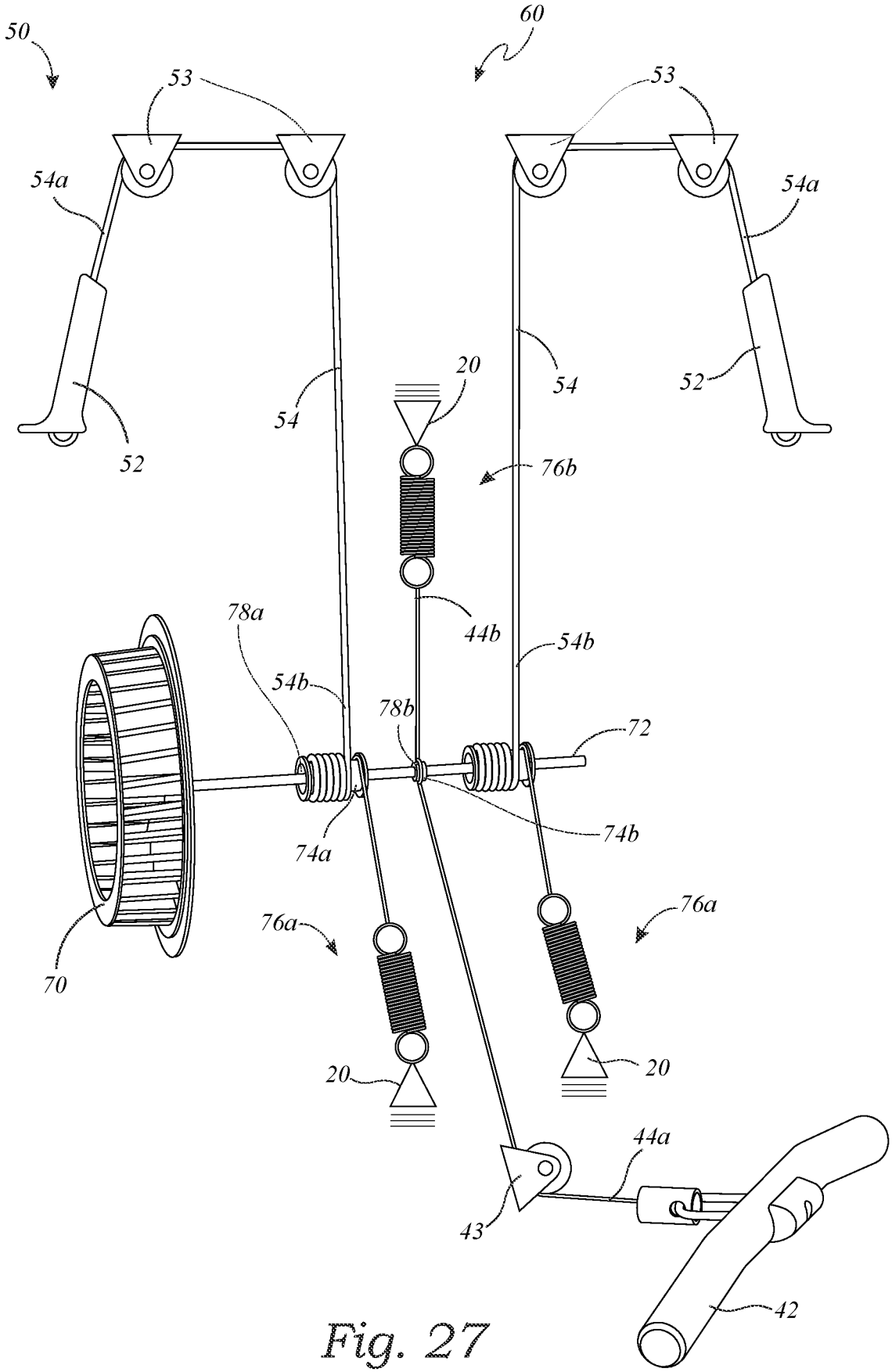
FIG. 27 is a schematic drawing of the transmission system of FIG. 25.

As shown in the Figures, the boom 30 further includes a seat element 46 which is slidably mounted on the boom 30 with sliders 47 so that when the boom 30 is in the horizontal position, a user seated on the seat element 46 may slide forward and back to perform rowing exercises using the row assembly 40. The sliders 47 may be any suitable mechanism known in the art, such as wheels guided by channels within the boom 30, etc. The boom 30 may further include a pair of foot engagement structures 48 for receiving the user's feet while performing the rowing exercises. In one embodiment, the foot engagement structures 48 shall change their angular relationship to the boom 30 as the boom 30 pivots with respect to the base housing 20 from the generally horizontal position to the generally vertical position to increase the available workout area available to perform skiing exercises. In another embodiment, the foot engagement structures 48 shall maintain their angular relationship to the boom 30 as the boom 30 pivots with respect to the base housing 20 from the generally horizontal position to the generally vertical position. Further components of the row assembly 40 are shown in FIGS. 25-27 and discussed in greater detail below.

Figure 7:
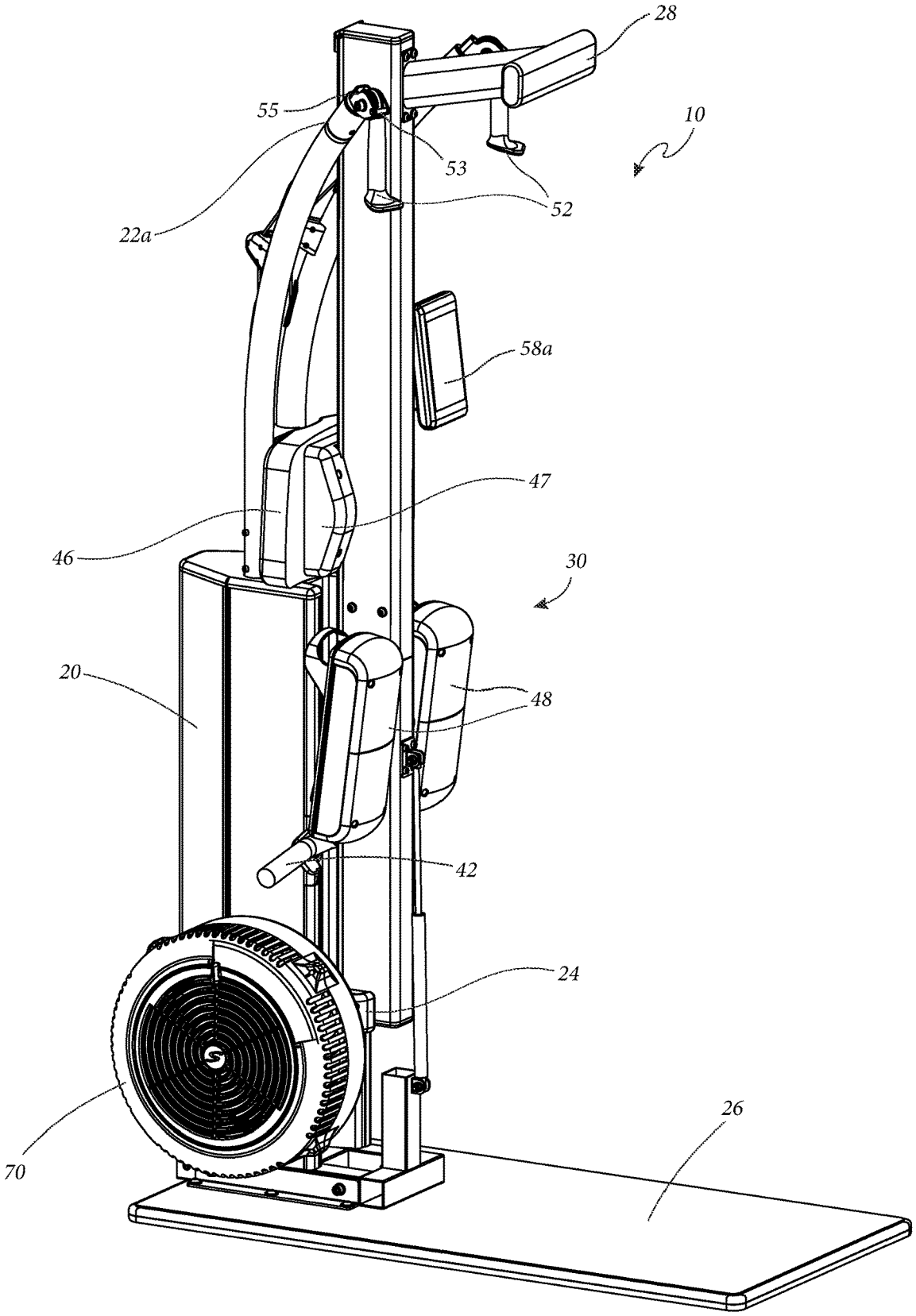
FIG. 7 is a left, side perspective view of the exercise machine in a skiing configuration.
Figure 8:
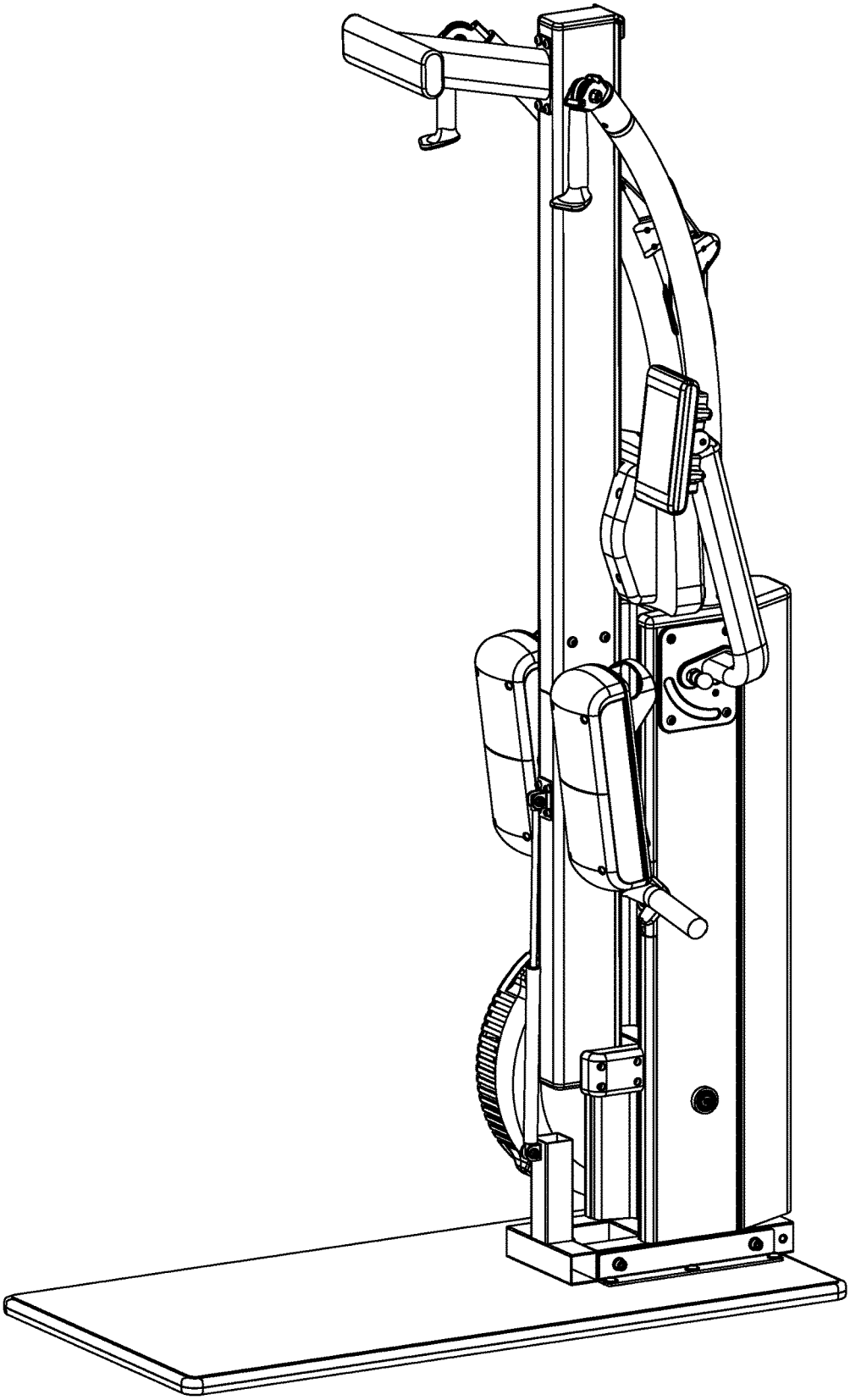
FIG. 8 is a right side perspective view thereof.
Figure 9:
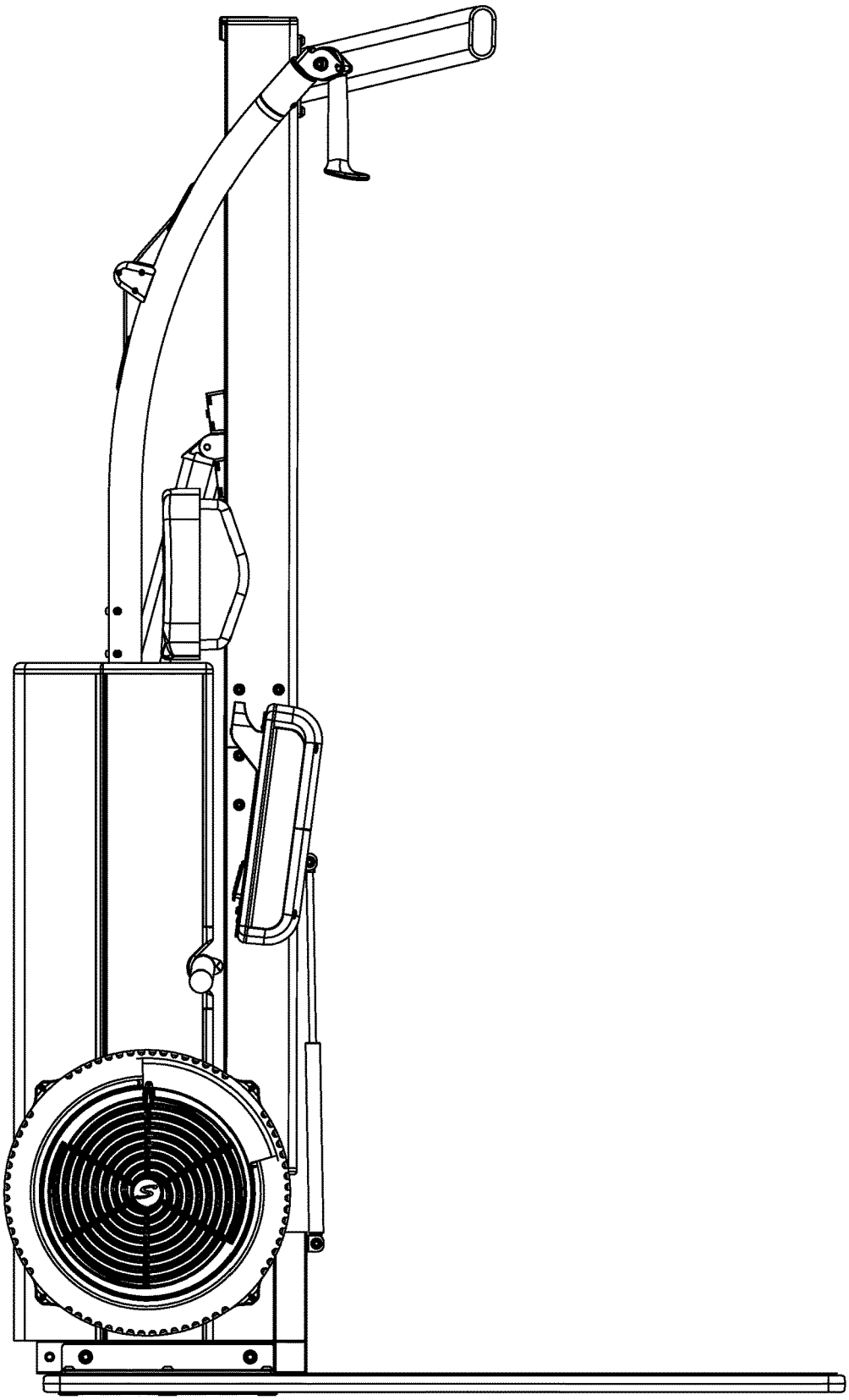
FIG. 9 is a left side elevational view thereof.
Figure 10:
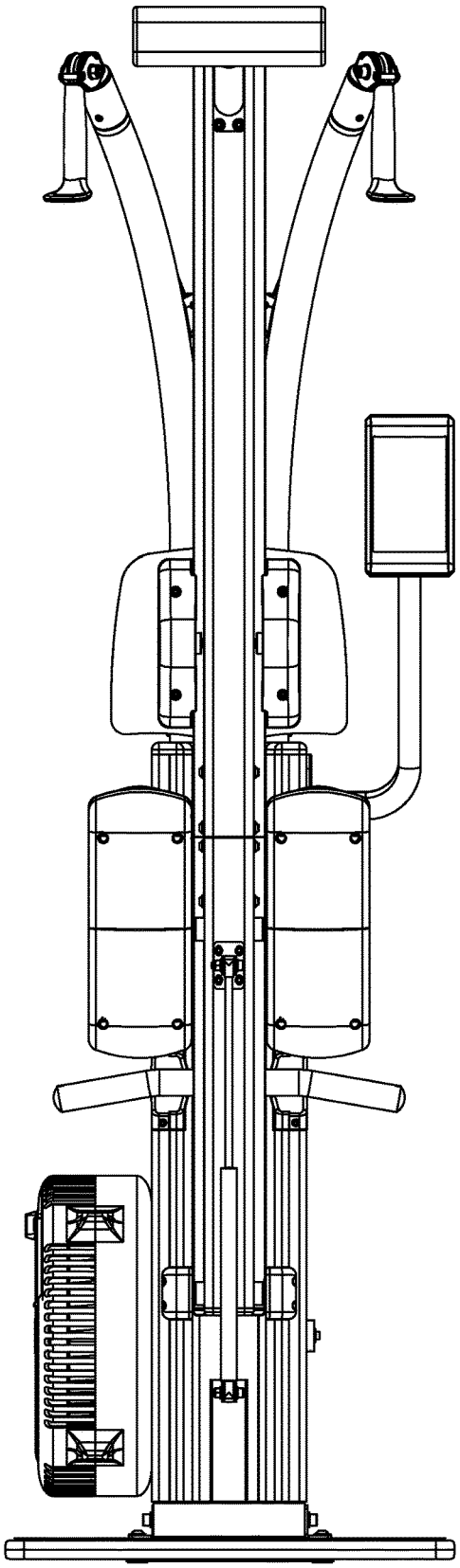
FIG. 10 is a front elevational view thereof.
Figure 11:
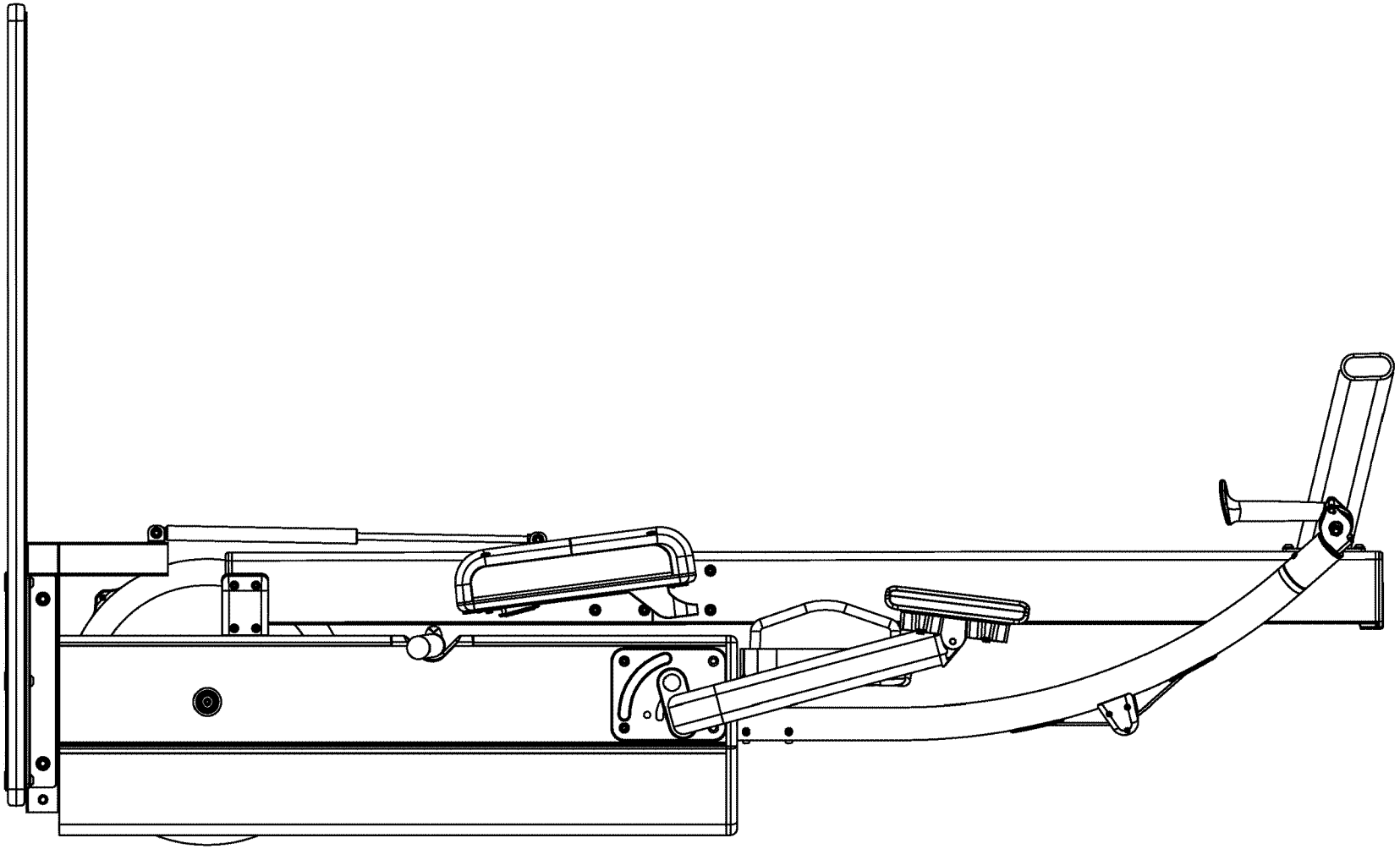
FIG. 11 is a right side elevational view thereof.
Figure 12:
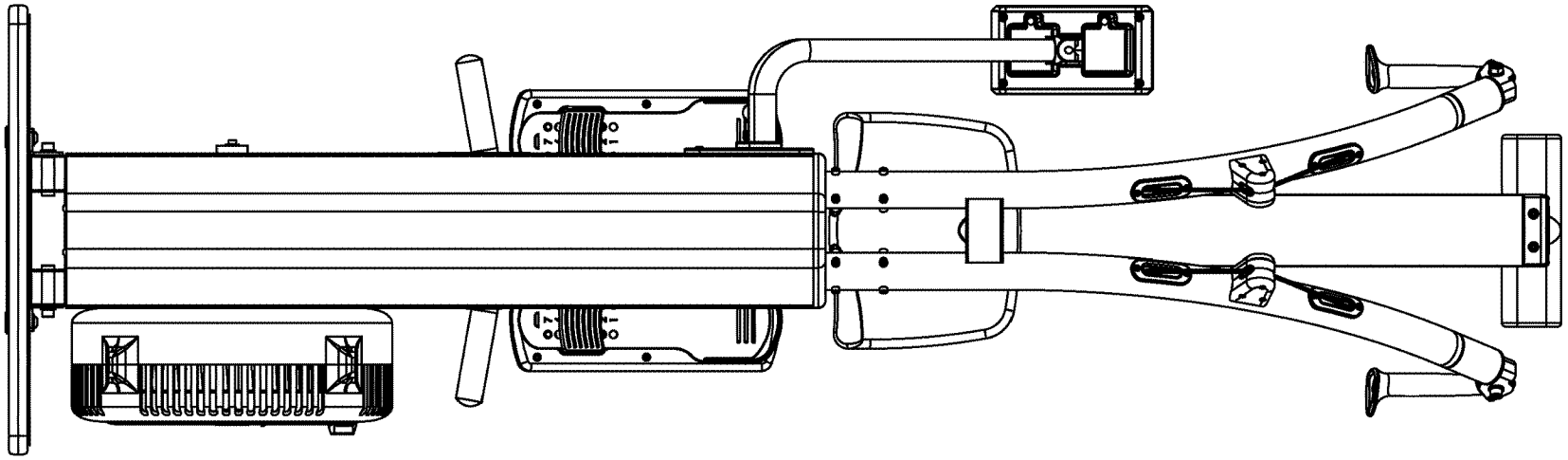
FIG. 12 is a rear elevational view thereof.

FIG. 7 is a left side perspective view of the exercise machine 10 in the skiing configuration. FIG. 8 is a right side perspective view, FIG. 9 is a left side elevational view, FIG. 10 is a front elevational view, FIG. 11 is a right side elevational view, and FIG. 12 is a rear elevational view thereof. A user may exercise using a ski assembly 50 in the skiing configuration. The ski assembly 50 includes ski handles 52, each ski handle 52 being attached to a proximal end 54*a* of a ski rope 54 which extends through a ski handle stop 55 at the distal end 22*a* of the base housing 20, around at least one guide pulley 53, and downwardly into the base housing 20, where a distal end 54*b* of the ski rope 54 is attached to the transmission 60, and further attached to a ski recoil device 76*a* (as shown in FIG. 27).

In this configuration, the ski handles 52 are mounted a suitable height above the user at the distal end 22*a* of a base housing 20, which may be adjustable, as is well known in the art. The ski handle stops 55 prevent the ski handles 52 from being pulled into the base housing 20. In this embodiment, the base housing 20 is a hollow construction that houses the transmission 60 so that they are not exposed.

The exercise machine 10 further includes the resistance device 70 mounted on the base housing 20 for providing resistance to the ski assembly 50 and the row assembly 40, as described in greater detail below. In this embodiment, the resistance device 70 is in the form of an air displacement fan, flywheel, or combination thereof. While one embodiment of the resistance device 70 is shown, alternative forms of resistance devices known to those skilled in the art may also be used, e.g., water or magnetic displacement mechanisms, friction based mechanisms, etc., which should be considered within the scope of the present invention. The transmission system 60 therefore operatively connects the ski rope 54 and the row chain 44 to the resistance device 70.

As shown in the Figures, the exercise machine 10 may further comprise a computer display 58*a* for displaying feedback (e.g., calories burned, etc.) or entertainment (e.g., an instructional video, etc.) to the user. The machine 10 may further include additional, optional features for providing data to the user. In some embodiments, the computer display 58*a* shall be mounted to an adjustable arm 58*b*, as shown in FIG. 1, which enables the location of the computer display 58*a* to be adjusted to the position desired by the user.

Figure 13:
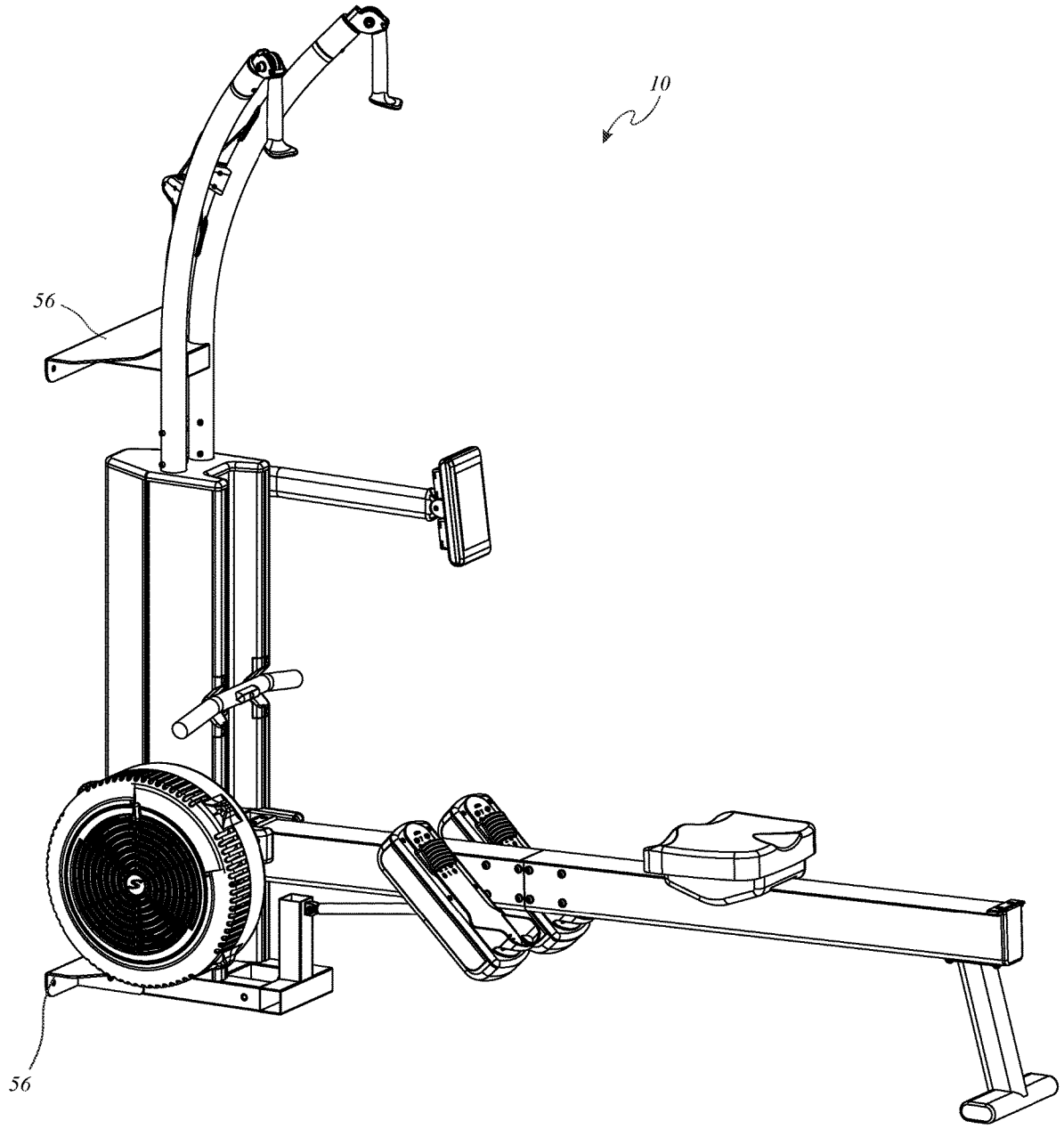
FIG. 13 is a left side perspective view of the exercise machine in the rowing configuration with wall mounting brackets installed instead of the support platform.
Figure 14:
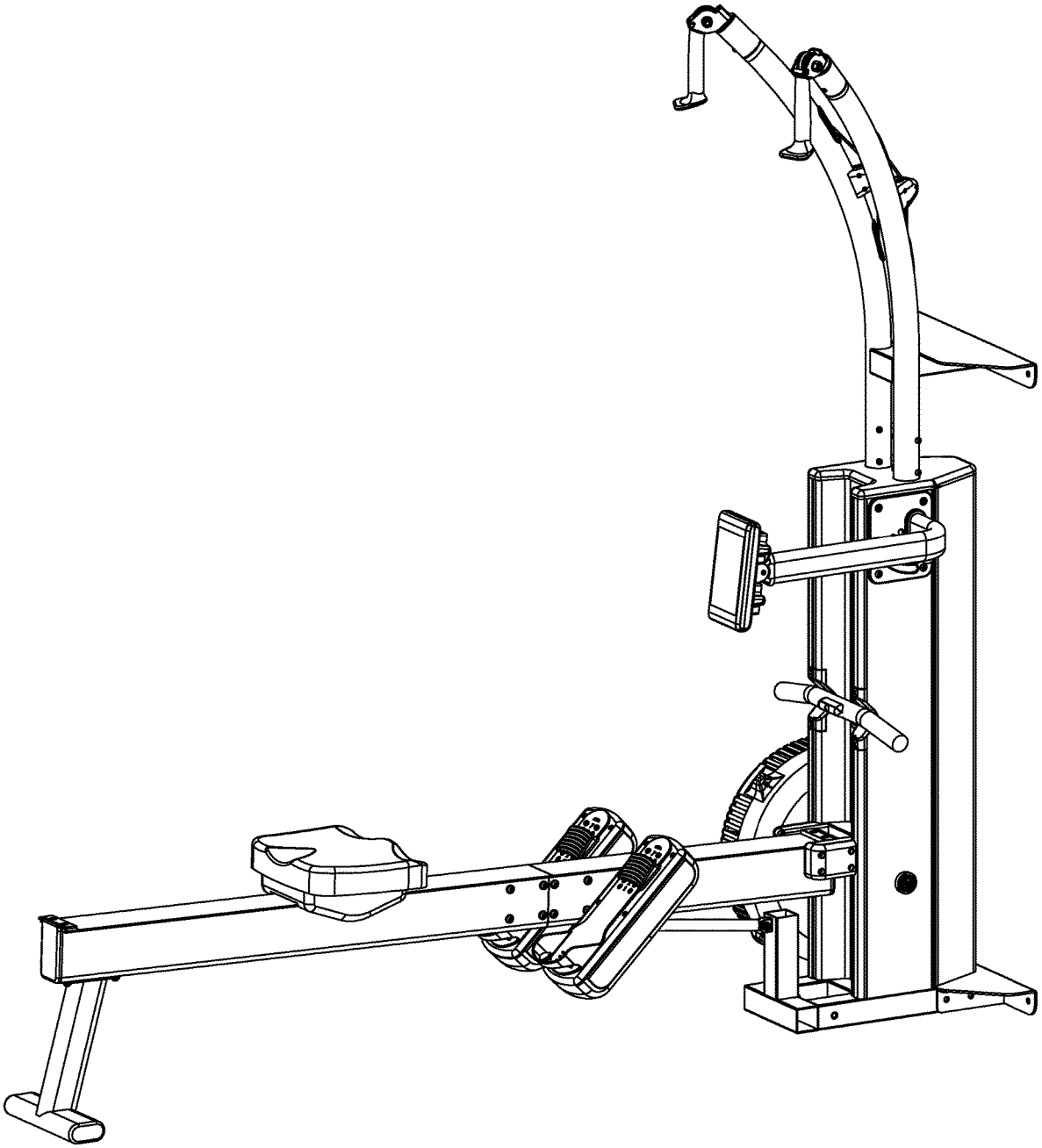
FIG. 14 is a right side perspective view thereof.
Figure 15:
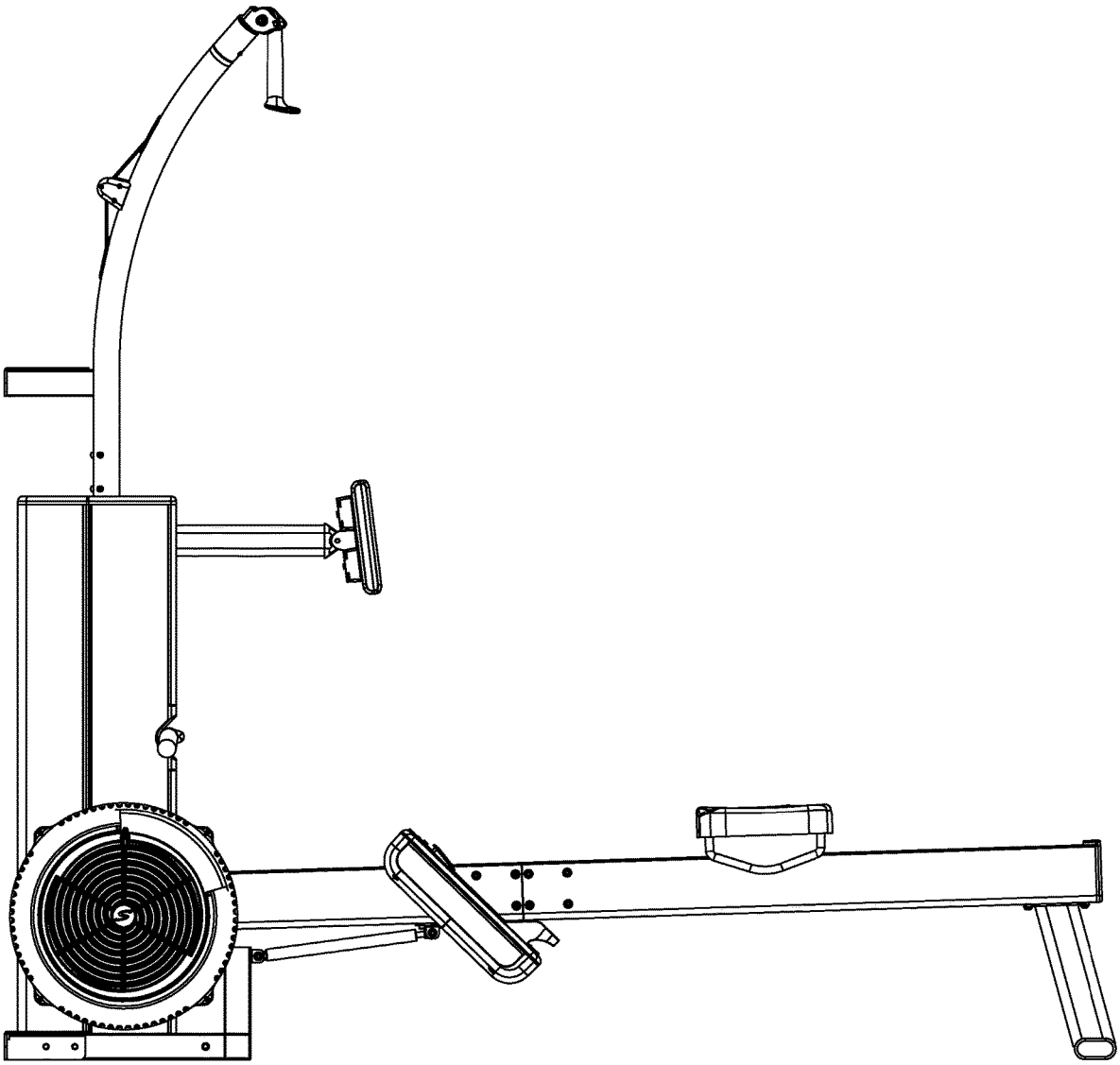
FIG. 15 is a left side elevational view thereof.
Figure 16:
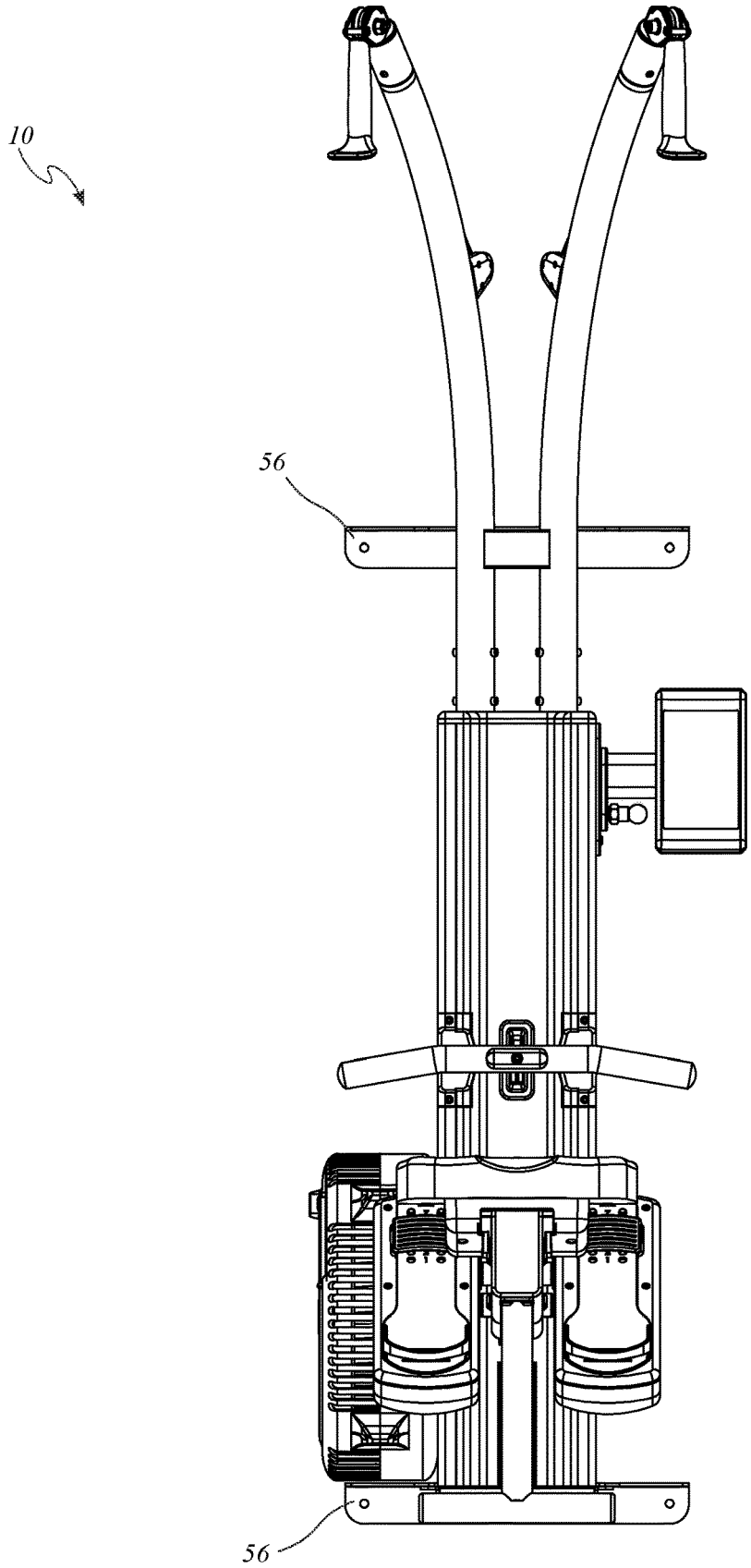
FIG. 16 is a front elevational view thereof.
Figure 17:
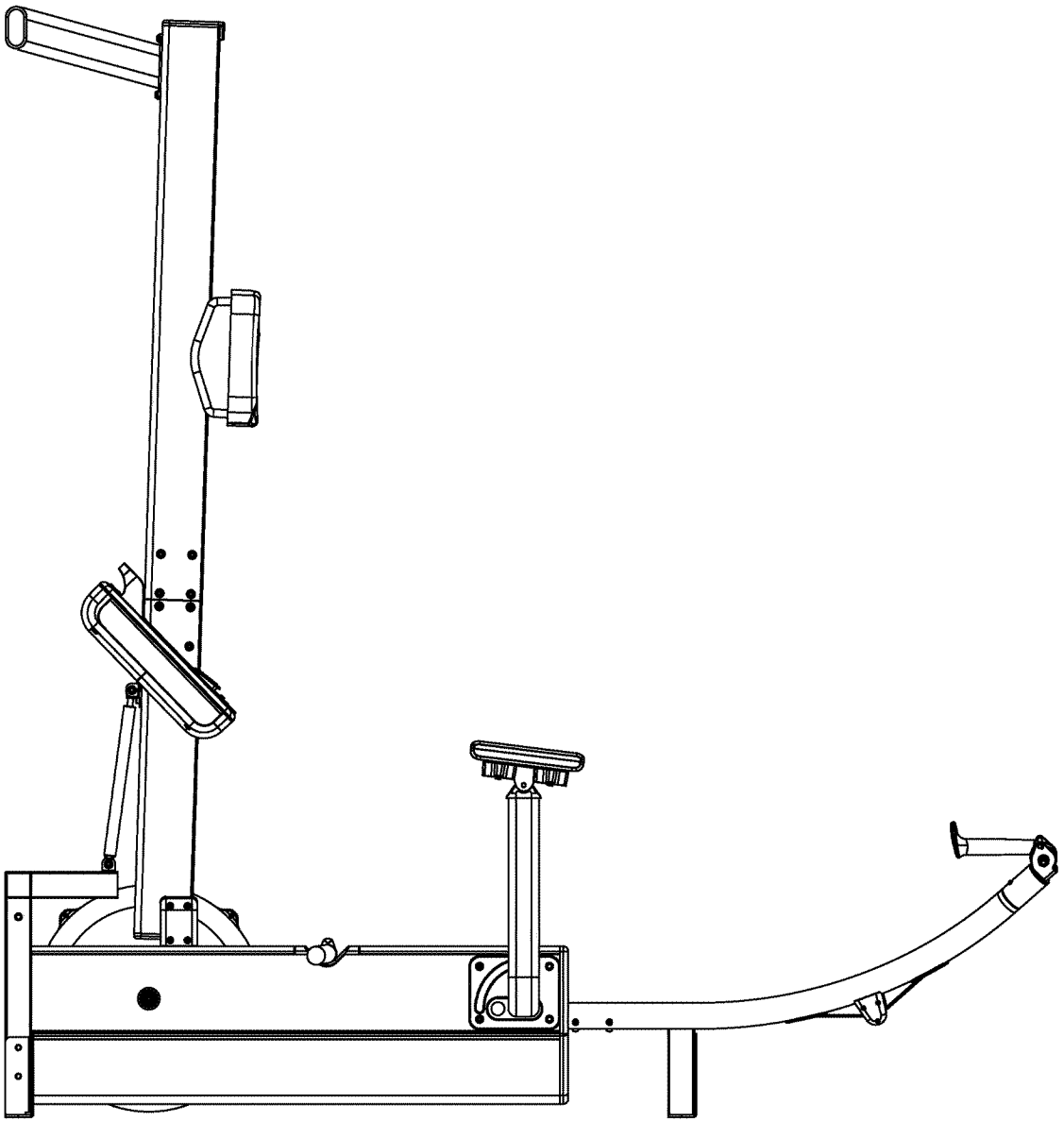
FIG. 17 is a right side elevational view thereof.
Figure 18:
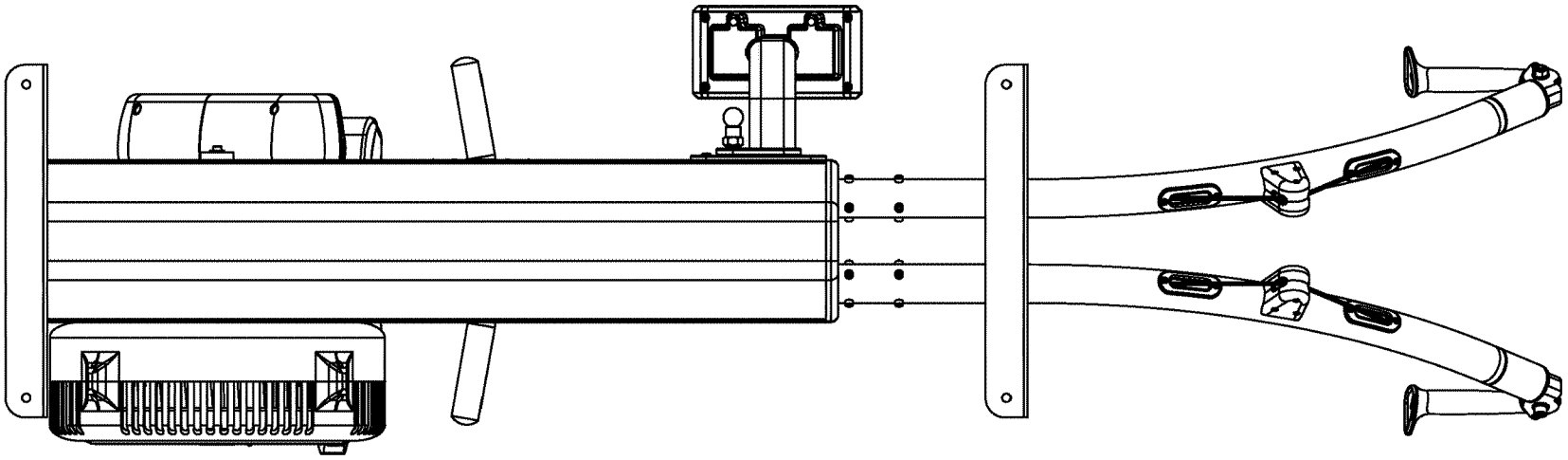
FIG. 18 is a rear elevational view thereof.
Figure 19:
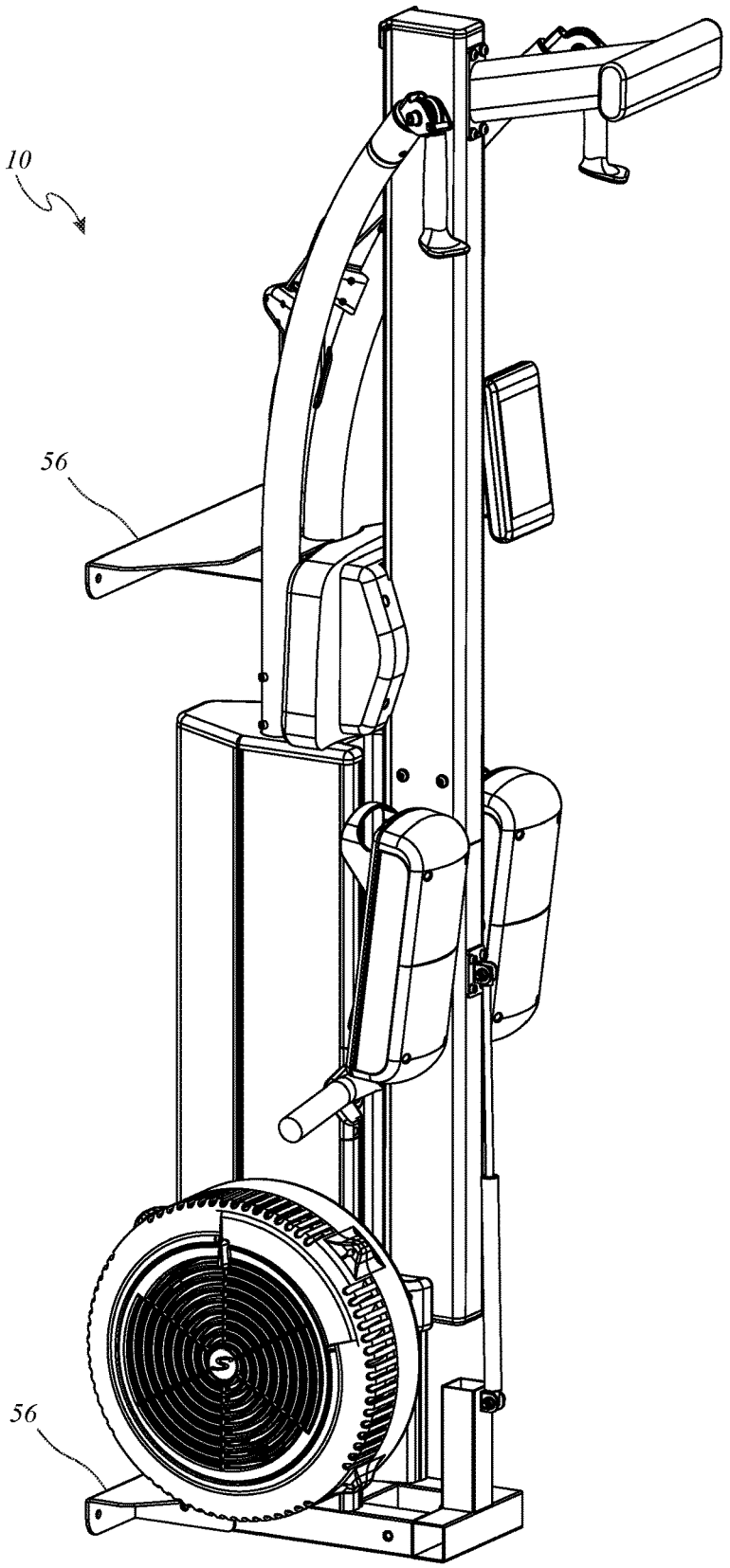
FIG. 19 is a left side perspective view of the exercise machine in the skiing configuration with the wall mounting brackets installed.
Figure 20:
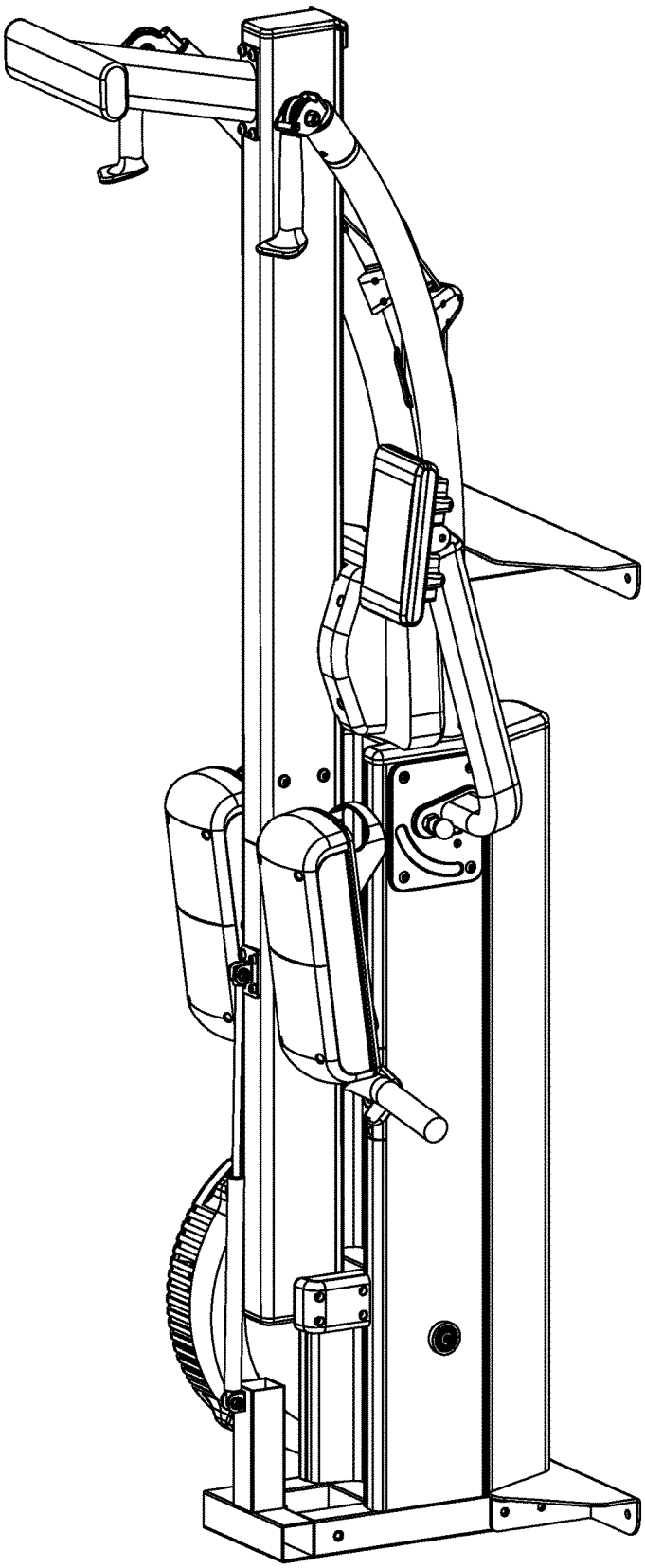
FIG. 20 is a right side perspective view thereof.
Figure 21:
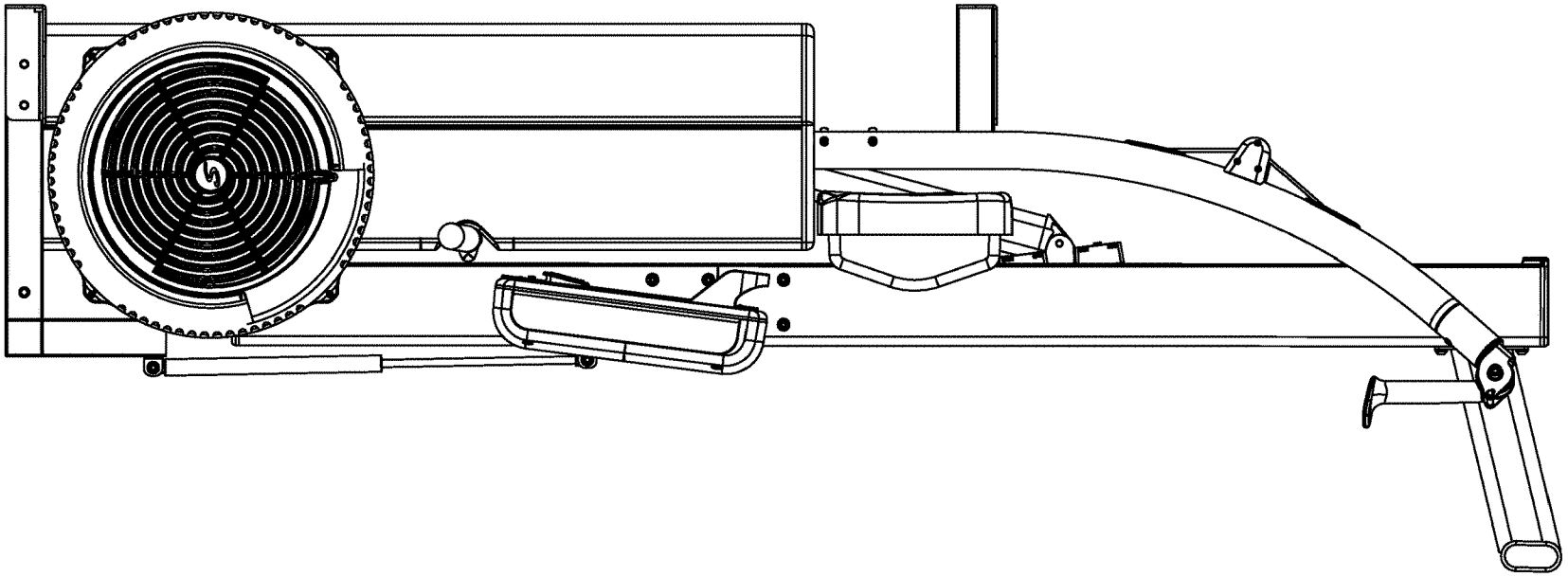
FIG. 21 is a left side elevational view thereof.
Figure 22:
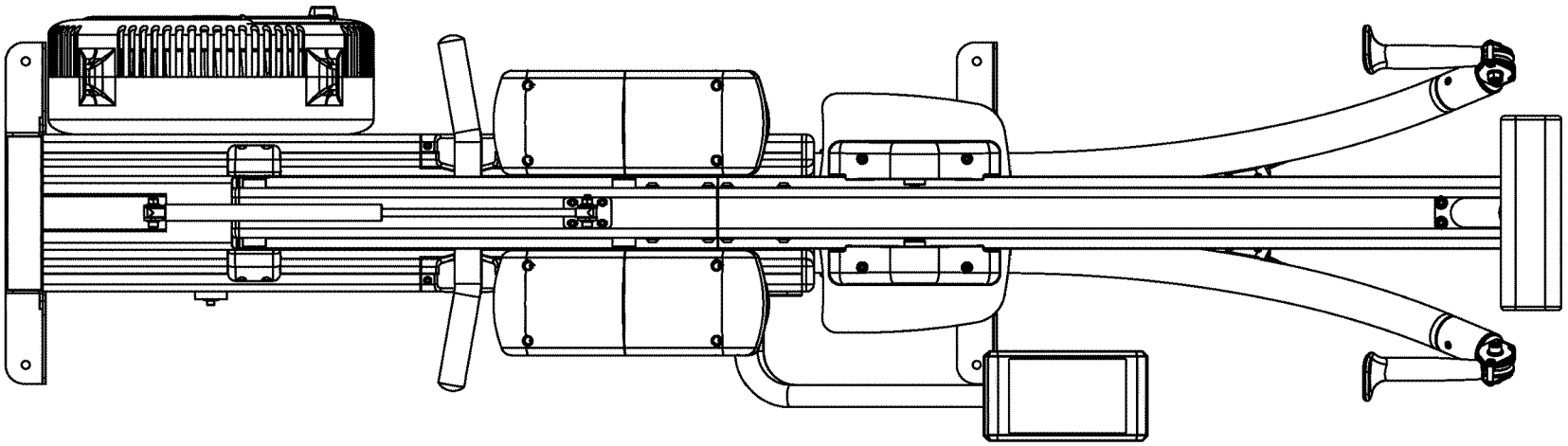
FIG. 22 is a front elevational view thereof.
Figure 23:
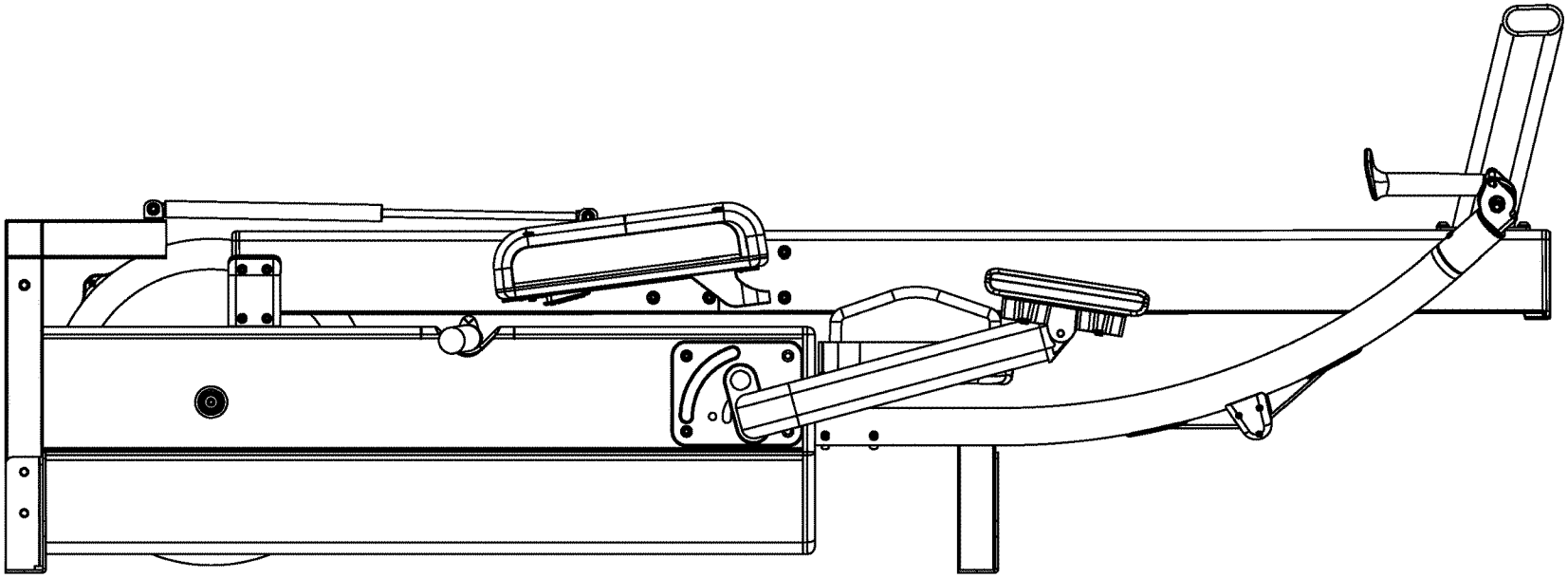
FIG. 23 is a right side elevational view thereof.
Figure 24:
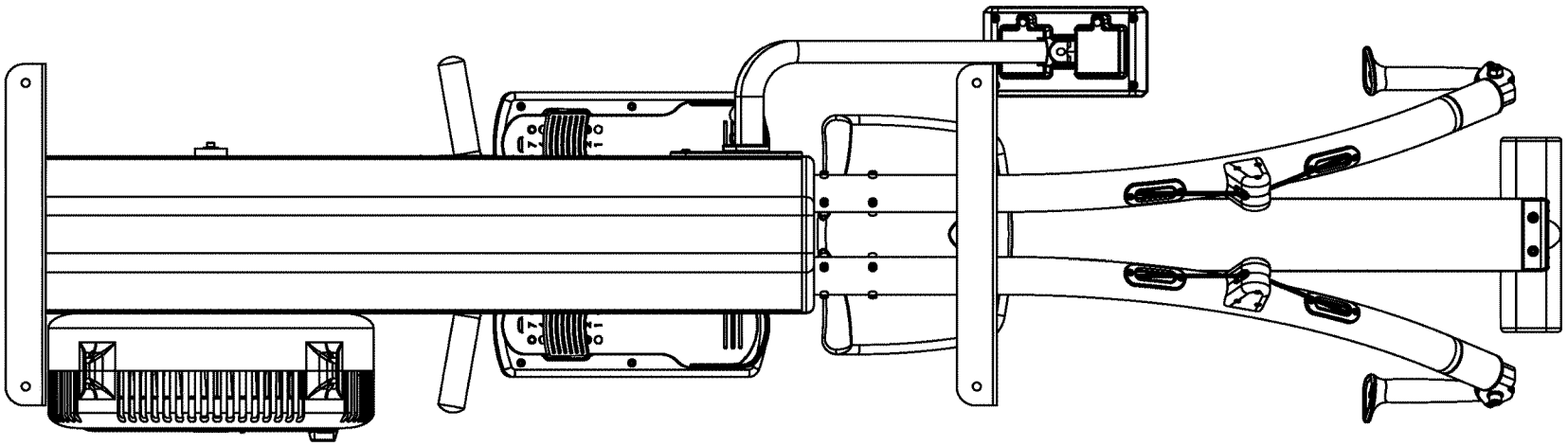
FIG. 24 is a rear elevational view thereof.

FIG. 13 is a left side perspective view of the exercise machine 10 in the rowing configuration with wall mounting brackets 56 installed. FIG. 14 is a right side perspective view, FIG. 15 is a left side elevational view, FIG. 16 is a front elevational view, FIG. 17 is a right side elevational view, and FIG. 18 is a rear elevational view thereof. FIG. 19 is a left side perspective view of the exercise machine 10 in the skiing configuration with the wall mounting brackets 56 installed. FIG. 20 is a right side perspective view, FIG. 21 is a left side elevational view, FIG. 22 is a front elevational view, FIG. 23 is a right side elevational view, and FIG. 24 is a rear elevational view thereof. As shown in FIGS. 13-24, the exercise machine 10 may include the wall mounting brackets 56 instead of the support platform 26 of FIGS. 1-12. The wall mounting brackets 56 may be any form of bracket or attachment piece capable of securing the exercise machine 10 to a wall, column, or other stabilizing surface. Other mechanisms may be employed to help stabilize the machine 10, which is well known in the art and should be considered within the scope of the present invention.

FIG. 25 is a front elevational view of the exercise machine 10 showing one embodiment of a transmission system 60 used to operably connect the ski ropes 54 and the row chain 44 described above with the resistance device 70. FIG. 26 is a rear perspective view thereof. FIG. 27 is a schematic drawing of the transmission system 60 of FIG. 25, to better illustrate the operative relationships of the various components of the transmission system 60.

As shown in FIGS. 25 and 27, the transmission system 60 comprises a shaft 72 that is operably connected to the resistance device 70. The shaft 72 includes various spools, as discussed below, for operatively engaging the ropes 54 and chain 44 with the shaft. For purposes of this application, the terms "spool" and "sprocket" are defined to include any form of spool, cylinder, sprocket, or any other form of similar or equivalent mechanism known in the art for operatively engaging cables, as discussed herein.

In this embodiment, the shaft 72 includes a row sprocket 74*b* and a pair of ski spools 74*a*, the row sprocket 74*b* and each of the ski spools 74*a* being mounted upon one-way bearings 78*b* and 78*a*, respectively, on the shaft 72, allowing each chain 44 and rope 54, respectively, to drive the shaft 72 independently. In this embodiment, the one way bearing 78*b* of the row sprocket 74*b* operates in the same direction of the one way bearings 78*a* of the pair of ski spools 74*a*.

Each of the ski ropes 54 contacts one of the ski spools 74*a* so that movement of the ski rope 54 rotates the ski spool 74*a*, thereby rotating the shaft 72. The row chain 44 contacts the row sprocket 74*b* so that movement of the row chain 44 rotates the row sprocket 74*b*, thereby rotating the shaft 72. When the shaft 72 rotates, it operates the resistance device 70 to provide resistance to a user exercising. In some embodiments, the resistance device 70 may be driven with a chain and sprockets, toothed belt, frictional belt, pulleys, gears or other means known to those skilled in the art.

As discussed above, the row assembly 40 includes the row handle 42 connected to the row chain 44, which extends upwardly to feed through the at least one guide pulley 43 and operably engage the row sprocket 74*b*, which in this embodiment is positioned between the ski spools 74*a* on the shaft 72.

The distal end 44*b* of the row chain 44 is attached to a row recoil device 76*b*, which functions to provide a bias towards a starting position of the row assembly. In this embodiment, the row recoil device 76*b* is in the form of a coiled spring that is anchored to the base housing. As illustrated in other figures, this elastic bungee may extend around pulleys to provide the necessary length. However, the recoil device may alternatively or additionally include any recoil device known in the art, such as a coiled spring, or other elastic or recoil mechanism known in the art.

In this embodiment, the ski spools 74*a* are each in the form of cylinders around which the distal end 54*b* of one of the ski ropes 54 is wrapped. A ski recoil device 76*a* provides a bias to the ski rope (in this case via the ski spool). In this embodiment, the ski recoil device 76*a* is in the form of an elastic cord that is anchored to the base housing and wrapped around the ski spool 74*a*, although it may also/alternatively include a coiled spring or similar/equivalent mechanism, as noted above.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. An exercise machine comprising:

a base housing;

a boom having an elongate rigid body that extends from a proximal end of the boom to a distal end of the boom;

a pivot mount which pivotally mounts the proximal end of the boom on the base housing such that the boom is able to pivot with respect to the base housing between a rowing configuration wherein the boom is generally horizontal, and a skiing configuration wherein the boom is generally vertical;

a seat element which is slidably mounted on the boom;

a rowing assembly that includes a row handle attached to a proximal end of a row chain which extends into the base housing;

a ski assembly that includes a pair of ski handles, each ski handle being attached to a proximal end of a ski rope which extends around at least one guide pulley, such that a distal end of the ski rope extends into the base housing;

a resistance device; and a transmission system within the base housing that connects the ski ropes and the row chain to the resistance device, the transmission system comprising:

a shaft that is operably connected to the resistance device, the shaft having a row sprocket and a pair of ski spools;

wherein each of the ski ropes contacts one of the pair of ski spools so that movement of the ski rope rotates the ski spool, respectively, thereby rotating the shaft; and wherein the row chain contacts the row sprocket so that movement of the row chain rotates the row sprocket, thereby rotating the shaft.

2. The exercise machine of claim 1, wherein the row sprocket and the pair of ski spools are respectively mounted upon one-way bearings on the shaft.

3. The exercise machine of claim 2, wherein the one-way bearing of the row sprocket operates in a same direction as the one-way bearing of each of the pair of ski spools.

4. The exercise machine of claim 1, wherein each of the pair of ski spools is in the form of a cylinder around which the respective ski rope is wrapped.

5. The exercise machine of claim 1, wherein the row sprocket is in the form of a sprocket, and the row chain is in the form of a chain that operatively engages the row sprocket, and extends to a row recoil device.

6. The exercise machine of claim 1, wherein the resistance device is in the form of an air displacement fan.

7. The exercise machine of claim 5, wherein the row recoil device is in the form of an elastic cord.

8. The exercise machine of claim 1, wherein the boom further includes a pair of foot engagement structures for receiving feet of a user while the user performs rowing exercises.

9. The exercise machine of claim 1, wherein a handle receiver is mounted on the base housing to catch and hold the row handle while not in use.

10. The exercise machine of claim 1, further comprising a computer display for displaying feedback or entertainment.

11. The exercise machine of claim 10, wherein the computer display is adjustably mounted on an adjustable arm.

12. An exercise machine comprising:

a base housing;

a boom having an elongate rigid body that extends from a proximal end of the boom to a distal end of the boom;

a pivot mount which pivotally mounts the proximal end of the boom on the base housing such that the boom is able to pivot with respect to the base housing between a rowing configuration wherein the boom is generally horizontal, and a skiing configuration wherein the boom is generally vertical;

a seat element which is slidably mounted on the boom;

a rowing assembly that includes a row handle attached to a proximal end of a row chain which extends into the base housing, wherein a distal end of the row chain is operatively engaged with a row recoil device;

a ski assembly that includes a pair of ski handles, each ski handle being attached to a proximal end of a ski rope which extends through a ski handle stop at a distal end of the base housing, around at least one guide pulley, such that a distal end of the ski rope extends into the base housing;

a resistance device; and a transmission system within the base housing that connects the ski rope and the row chain to the resistance device, the transmission system comprising:

a shaft that is operably connected to the resistance device, the shaft having a row sprocket and a pair of ski spools, wherein the row sprocket and the pair of ski spools are respectively mounted upon one-way bearings on the shaft;

wherein each of the ski ropes contacts one of the pair of ski spools so that movement of the ski rope rotates the ski spool, respectively, thereby rotating the shaft, and wherein the distal end of each of the ski ropes is operatively attached to a ski recoil device; and wherein the row chain contacts the row sprocket so that movement of the row chain rotates the row sprocket, thereby rotating the shaft.

* * * * *